US011388952B2

(12) United States Patent
Nakaya et al.

(10) Patent No.: US 11,388,952 B2
(45) Date of Patent: Jul. 19, 2022

(54) SHOE WITH REINFORCEMENT DEVICE FOR REINFORCING AN UPPER

(71) Applicant: Asics Corporation, Kobe (JP)

(72) Inventors: Seigo Nakaya, Kobe (JP); Yoshihito Tahira, Kobe (JP)

(73) Assignee: ASICS CORPORATION

( * ) Notice: Subject to any disclaimer, the term of this patent is extended or adjusted under 35 U.S.C. 154(b) by 495 days.

(21) Appl. No.: 16/317,327

(22) PCT Filed: Jul. 11, 2017

(86) PCT No.: PCT/JP2017/025264
§ 371 (c)(1),
(2) Date: Jan. 11, 2019

(87) PCT Pub. No.: WO2018/016382
PCT Pub. Date: Jan. 25, 2018

(65) Prior Publication Data

US 2019/0297999 A1 Oct. 3, 2019

(30) Foreign Application Priority Data

Jul. 19, 2016 (JP) ..... JP2016-141556

(51) Int. Cl.
*A43B 13/41* (2006.01)
*A43B 23/08* (2006.01)
*A43B 23/17* (2006.01)

(52) U.S. Cl.
CPC ..... *A43B 13/41* (2013.01); *A43B 23/08* (2013.01); *A43B 23/088* (2013.01); *A43B 23/17* (2013.01)

(58) Field of Classification Search
CPC ..... A43B 13/41; A43B 23/08; A43B 23/088; A43B 23/17; A43B 7/20; A43B 7/24
(Continued)

(56) References Cited

U.S. PATENT DOCUMENTS 1,446,034 A * 2/1923 Conion ..... A43B 23/08 36/68
1,465,233 A * 8/1923 Posner ..... A43B 17/16 602/65

(Continued)

FOREIGN PATENT DOCUMENTS

CN 102762121 A 10/2012
JP 64-8904 A 1/1989

(Continued)

OTHER PUBLICATIONS

International Search Report for International Application No. PCT/JP2017/025264 dated Oct. 10, 2017.

*Primary Examiner* — Jocelyn Bravo
(74) *Attorney, Agent, or Firm* — Katten Muchin Rosenman LLP

(57) ABSTRACT

A reinforcement device reinforcing an upper includes: a rear first portion placed between a sole and a top line in a rear end portion of the upper; a rear second portion placed in a boundary portion between the upper and the sole in the rear end portion of the upper; a lateral first portion being continuous with the rear first portion and extending toward the sole on the lateral side; a medial first portion being continuous with the rear first portion and extending toward the sole on the medial side, the medial first portion being less flexurally deformable than the lateral first portion; and a medial second portion being continuous with the rear second portion and extending toward an anterior direction from the rear second portion along the medial side boundary portion so that the medial side boundary portion is less flexurally deformable than the lateral side boundary portion.

2 Claims, 30 Drawing Sheets

(58) Field of Classification Search
USPC ..... 36/69
See application file for complete search history.

(56) References Cited

U.S. PATENT DOCUMENTS 1,585,049 A * 5/1926 Skoglund ..... A43B 23/28 36/58.5
1,636,982 A * 7/1927 Brittain ..... A43B 23/08 36/68
1,686,175 A * 10/1928 Read ..... A43B 11/00 36/58.5
2,080,959 A * 5/1937 Cobb ..... A43B 23/08 36/68
2,207,699 A * 7/1940 Pliskoff ..... A43B 3/12 36/105
2,261,453 A * 11/1941 Reinhart ..... A43B 23/14 36/89
2,293,245 A * 8/1942 Duplessis ..... A43B 23/08 12/142 R
2,319,356 A * 5/1943 Sullivan ..... A43B 23/08 36/68
2,348,300 A * 5/1944 Klaus ..... A43B 13/41 36/154
2,447,590 A * 8/1948 Meltzer ..... A43B 9/14 36/19.5
2,523,221 A * 9/1950 Maloy ..... A43B 3/12 36/1
2,661,549 A * 12/1953 Lindner ..... A43B 23/17 36/55
2,738,600 A * 3/1956 Shultz ..... A43B 23/17 36/68
2,867,920 A * 1/1959 Dube ..... A43B 23/08 36/68
3,100,902 A * 8/1963 Scammon ..... A43B 23/08 12/146 D
3,203,117 A * 8/1965 Shelton ..... A43B 23/10 36/69
3,425,075 A * 2/1969 Murray ..... A43B 9/00 12/142 R
3,496,585 A * 2/1970 Jett, Jr. ..... A43B 23/088 12/146 C
3,780,454 A * 12/1973 Godwin ..... A43B 3/26 36/58.6
4,287,675 A * 9/1981 Norton ..... A43B 23/17 36/129
4,506,460 A * 3/1985 Rudy ..... A43B 7/1495 36/28
4,523,394 A * 6/1985 Lindh ..... A61F 5/0111 36/89
4,625,435 A * 12/1986 Ueda ..... A43B 23/17 36/114
4,821,430 A * 4/1989 Flemming ..... A43B 23/17 36/68
4,854,055 A * 8/1989 Sugiyama ..... A43B 5/00 36/127
5,152,082 A * 10/1992 Culpepper ..... A43B 7/14 36/114
5,279,051 A * 1/1994 Whatley ..... A43B 13/181 36/114
5,316,545 A * 5/1994 Cherubini ..... A43B 7/141 264/222
5,317,820 A * 6/1994 Bell ..... A43B 5/00 36/114
5,498,033 A * 3/1996 Hoshizaki ..... A43B 1/0018 280/841
5,625,963 A * 5/1997 Miller ..... A43B 7/1495 36/114
D383,513 S * 9/1997 Ryan ..... D2/973
5,896,683 A * 4/1999 Foxen ..... A43B 23/0275 36/89
5,901,469 A * 5/1999 Saillet ..... A43B 3/0063 36/118.2
5,903,984 A * 5/1999 Donnadieu ..... A43B 5/0411 36/118.2
6,000,148 A * 12/1999 Cretinon ..... A43B 5/00 36/69
6,082,026 A * 7/2000 Sand ..... A43B 5/0401 36/117.1
6,170,175 B1 * 1/2001 Funk ..... A43B 5/04 36/115
6,401,366 B2 * 6/2002 Foxen ..... A43B 7/1495 36/102
6,543,793 B1 * 4/2003 Reuss ..... A43B 5/04 280/11.36
6,557,271 B1 * 5/2003 Weaver, III ..... A43B 3/0063 36/144
6,715,218 B2 * 4/2004 Johnson ..... A41D 13/0531 36/45
7,168,188 B2 * 1/2007 Auger ..... A43B 3/0047 36/69
7,178,270 B2 * 2/2007 Hurd ..... A43B 11/02 36/138
8,020,317 B1 * 9/2011 Sokolowski ..... A43B 23/17 36/69
8,555,529 B2 * 10/2013 Antonelli ..... A43B 5/06 36/68
9,095,188 B2 * 8/2015 Cavaliere ..... A43B 21/36
9,635,905 B2 * 5/2017 Dekovic ..... A43B 23/0245
10,159,310 B2 * 12/2018 Sullivan ..... A43C 11/12
10,455,898 B1 * 10/2019 Orand ..... A43B 7/20
10,531,702 B2 * 1/2020 Cin ..... A43B 5/025
10,617,174 B1 * 4/2020 Hopkins ..... A43B 13/148
10,638,810 B1 * 5/2020 Cheney ..... A43B 11/00
10,905,192 B1 * 2/2021 Cheney ..... A43B 3/248
2002/0050078 A1 * 5/2002 Dietrich ..... A43B 7/24 36/88
2002/0112376 A1 * 8/2002 Tomat ..... A43B 23/17 36/68
2002/0173739 A1 * 11/2002 Jensen ..... A43C 11/146 602/27
2003/0136026 A1 * 7/2003 Crary ..... A43B 23/16 36/58.5
2003/0177667 A1 * 9/2003 Hussain ..... A61F 5/14 36/144
2003/0193151 A1 * 10/2003 Reuss ..... A43B 5/04 280/11.36
2003/0233770 A1 * 12/2003 Foscaro ..... A43B 5/10 36/50.1
2004/0016150 A1 * 1/2004 Labonte ..... A43B 7/16 36/115
2005/0039348 A1 * 2/2005 Raluy ..... A43B 11/00 36/50.1
2005/0138846 A1 * 6/2005 O'Connor ..... A43B 23/30 36/72 B
2005/0193594 A1 * 9/2005 Murphy ..... A43B 5/1616 36/89
2006/0075661 A1 * 4/2006 Ramsey ..... A43B 7/20 36/89
2006/0201032 A1 * 9/2006 Ramsey ..... A43B 7/20 36/89
2006/0222820 A1 * 10/2006 Liu ..... B29C 66/431 428/174
2006/0248752 A1 * 11/2006 Kittner ..... A43B 23/0265 36/69
2007/0130800 A1 * 6/2007 Twomey ..... A43B 3/16 36/50.1
2008/0000106 A1 * 1/2008 Culpepper ..... A43B 23/17 36/89
2010/0036306 A1 * 2/2010 Lussier ..... A61F 5/0111 602/65
2010/0043254 A1 * 2/2010 Dobbin ..... A43B 5/16 36/114
2010/0293811 A1 * 11/2010 Truelsen ..... A43B 23/088 36/28
2010/0319217 A1 * 12/2010 Echols ..... A43B 23/0285 36/89
2011/0113650 A1 * 5/2011 Hurd ..... A43B 7/20 36/107

(56) References Cited

U.S. PATENT DOCUMENTS

2011/0185592 A1* 8/2011 Nishiwaki ..... A43B 7/16 36/69
2012/0096742 A1* 4/2012 Shim ..... A43B 23/17 36/45
2013/0118035 A1* 5/2013 Segato ..... A43B 13/16 36/102
2014/0135675 A1* 5/2014 Nayfa ..... A61F 5/0127 602/27
2014/0202044 A1* 7/2014 Adami ..... A43B 5/02 36/34 R
2014/0305005 A1* 10/2014 Yeh ..... A43B 7/143 36/69
2015/0047227 A1* 2/2015 Fallon ..... A43B 23/17 36/88
2016/0029743 A1* 2/2016 Cavaliere ..... A43B 5/00 36/105
2016/0174661 A1* 6/2016 Nonogawa ..... A43B 23/0265 36/88
2016/0242498 A1* 8/2016 Sakamoto ..... A43B 7/1495
2017/0273404 A1* 9/2017 Doenges ..... A43B 23/026
2017/0303632 A1* 10/2017 Pratt ..... A43B 3/248
2017/0347747 A1* 12/2017 Groeneweg ..... A43B 7/24
2018/0084864 A1* 3/2018 Takada ..... A43B 13/141
2018/0103722 A1* 4/2018 Jensen ..... A43B 17/00
2018/0110289 A1* 4/2018 Owings ..... A43B 23/0245
2018/0110292 A1* 4/2018 Beers ..... A43B 11/00
2018/0235311 A1* 8/2018 Laframboise ..... A43B 7/24
2019/0116917 A1* 4/2019 Sato ..... A43C 11/165
2019/0116924 A1* 4/2019 Darby ..... A43B 13/184
2019/0365048 A1* 12/2019 Fontaine ..... A43B 23/042
2020/0015543 A1* 1/2020 Roser ..... A43B 3/12
2020/0196703 A1* 6/2020 Hopkins ..... A43B 11/00
2020/0205511 A1* 7/2020 Hopkins ..... A43B 11/02
2020/0205516 A1* 7/2020 Kilgore ..... A43B 23/0245
2020/0205517 A1* 7/2020 Happen ..... A43B 23/0275
2020/0205518 A1* 7/2020 Hopkins ..... A43B 21/32
2020/0205520 A1* 7/2020 Kilgore ..... A43B 11/00
2020/0253333 A1* 8/2020 Kilgore ..... A43B 3/0063
2020/0359745 A1* 11/2020 Tresser ..... A43B 7/20
2021/0112916 A1* 4/2021 Schulten ..... A43B 23/0245
2021/0137217 A1* 5/2021 Beers ..... A43B 13/41

FOREIGN PATENT DOCUMENTS

JP 2005296101 A 10/2005
JP 5875168 B2 3/2016
WO 2011/062735 A1 5/2011
WO WO2010038267 A1 2/2012

* cited by examiner

FIG10A : Me.
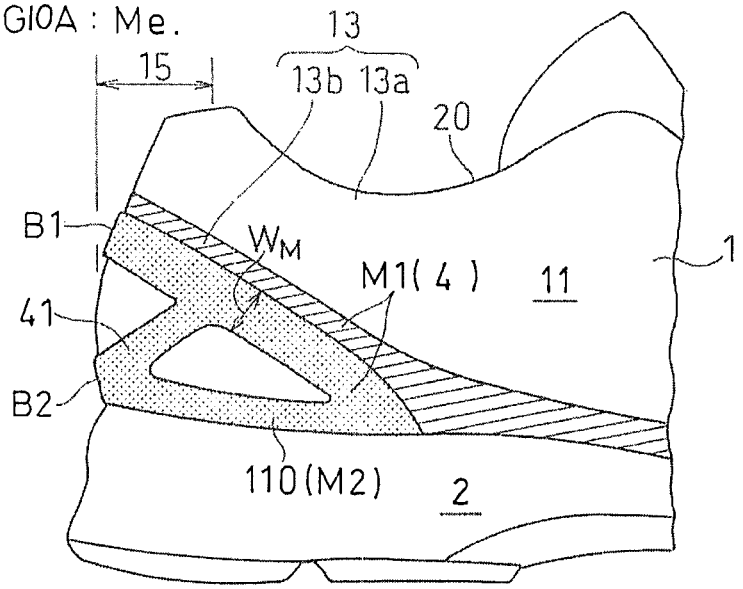
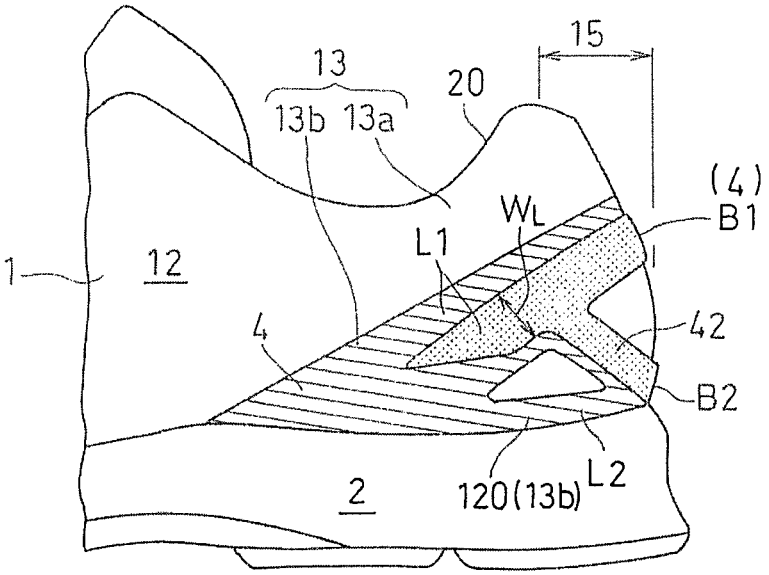
FIG10B : Lat.

FIG11A: Me.
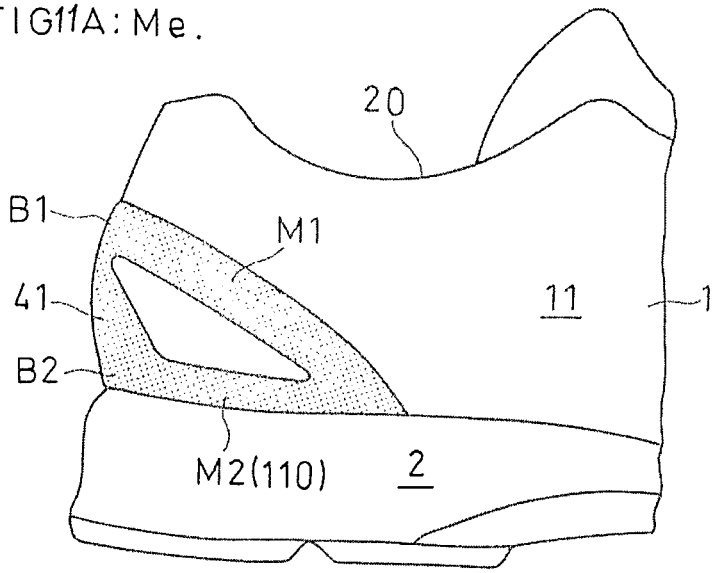
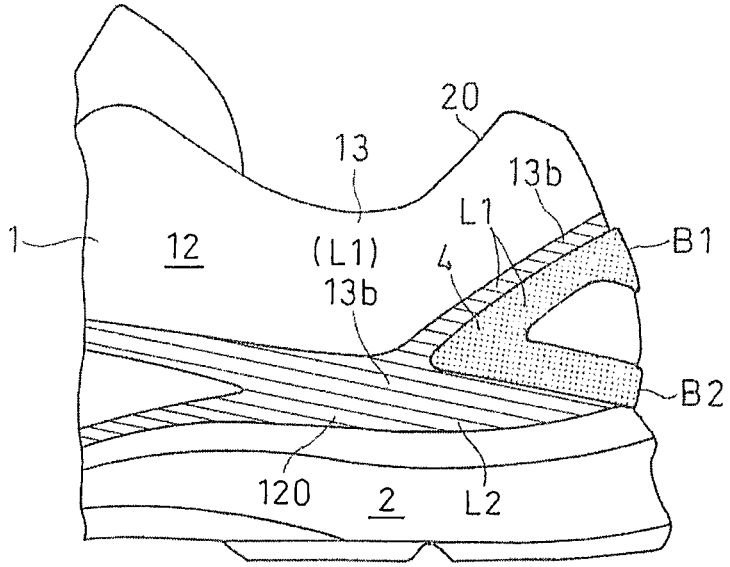
FIG11B: Lat.

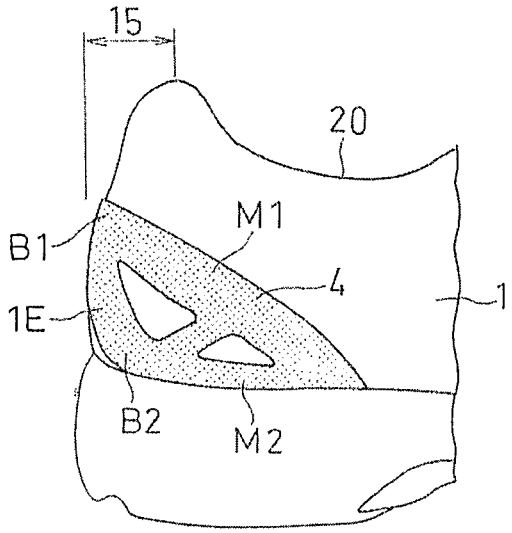
FIG12A : Me.
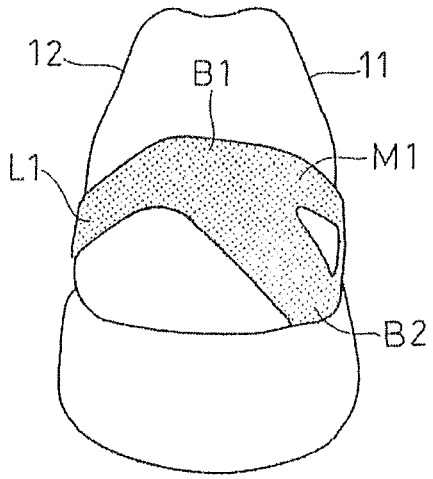
FIG12B
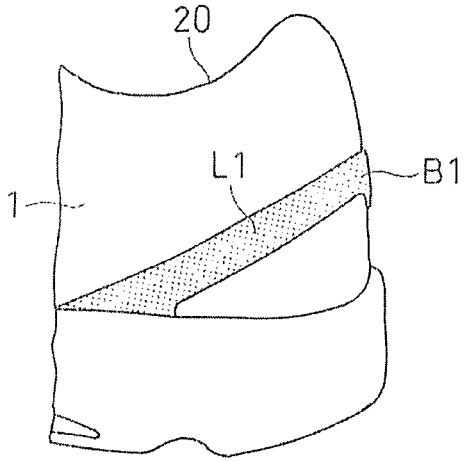
FIG12C : Lat.

FIG 30
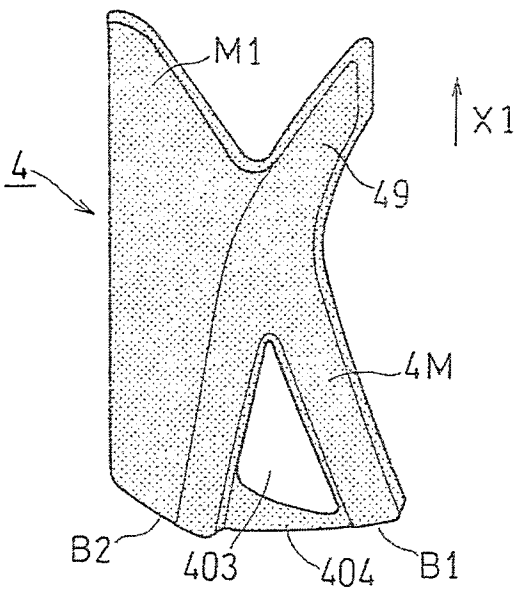
(b)
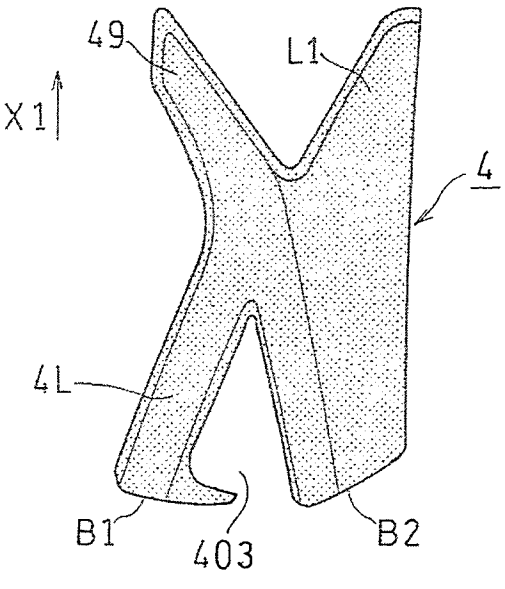
(a)

SHOE WITH REINFORCEMENT DEVICE FOR REINFORCING AN UPPER

TECHNICAL FIELD

The present invention relates to a shoe including a reinforcement device reinforcing a heel portion of an upper.

BACKGROUND ART

A heel counter, which is an example of a reinforcement device, covers the opposite side surfaces and the rear surface of the heel and maintains the shape of the heel portion of the upper. When the entire heel is wrapped around by the heel counter formed from a resin part, the heel portion of the upper has a high rigidity, but it inhibits the deformation of the upper in conformity with the shape of the heel of the wearer. That is, the fitting property of the heel portion deteriorates.

For example, heel counters formed in lattice shapes are known in the art, as described in the patent documents identified below. Moreover, heel counters having different shapes on the lateral side and on the medial side are known in the art.

CITATION LIST

Patent Literature

First Patent Document: WO2010/038267 A1 (FIGS. 1 and 2)

Second Patent Document: JP2005-296101/A1 (FIG. 3)

SUMMARY OF INVENTION

It is an object of the present invention to provide a reinforcement device of an upper of a shoe that improves the stability property and the following property (the conforming property) of the shoe from landing to takeoff while running.

A shoe in one aspect of the present invention includes: an upper 1, a reinforcement device 4 reinforcing the upper 1, and a sole 2 attached to the upper 1, wherein:

the upper 1 includes a lateral side boundary portion 120 between the upper and the sole 2 on a lateral side 12 of the upper, a medial side boundary portion 110 between the upper and the sole 2 on a medial side 11 of the upper, and a rear boundary portion 10 between the upper and the sole 2 in a rear end portion 15 of the upper;

the medial side boundary portion 110 and the lateral side boundary portion 120 are continuous with each other via the rear boundary portion 10; and the reinforcement device 4 includes:

a rear first portion B1 placed between the sole 2 and a top line (a collar or a wearing opening) 20 of the upper 1 in a rear end portion 15 of the upper;

a rear second portion B2 placed in the rear boundary portion 10;

a lateral first portion L1 being continuous with the rear first portion B1 and extending toward the sole 2 on the lateral side 12 of the upper;

a medial first portion M1 being continuous with the rear first portion B1 and extending toward the sole 2 on the medial side 11 of the upper, the medial first portion M1 being less flexurally deformable than the lateral first portion L1; and a medial second portion M2 being continuous with the rear second portion B2 and extending toward an anterior direction from the rear second portion B2 along the medial side boundary portion 110 on the medial side 11 of the upper so that the medial side boundary portion 110 is less flexurally deformable than the lateral side boundary portion 120.

With ordinary athletic shoes, a resin-made or resin-impregnated member, called a heel counter, is arranged on the medial and lateral sides of the heel portion. A heel counter maintains the shape of the shoe, and suppresses the pronation of the subtalar joint that occurs during the support period after landing. The flexural rigidity of the medial side of the heel counter substantially contributes to the suppression of the pronation, and it serves to support, by means of the medial side of the upper, the foot being urged to collapse toward the medial side. The medial first portion M1 and the medial side boundary portion 110, which are less flexurally deformable than the lateral first portion L1, will serve to suppress the pronation and improve the stability property.

The foot, which lands starting from the lateral side of the heel portion, exhibits pronation thereafter. The lateral side boundary portion 120 is more flexurally deformable and more compressively deformable than the medial side boundary portion 110, thereby increasing the amount of deformation of the lateral side boundary portion 120 upon heel contact. As a result, it is expected to suppress the speed at which the foot collapses toward the medial side and decrease the pronation to be exhibited thereafter.

In the latter half of the support period, the heel rises entailing the weight transfer, the forefoot portion of the sole dorsiflexes, and a restoring force occurs in the sole in such a direction that urges the rearfoot portion of the sole away from the foot. At this point, the upper is required to have a good foot fitting property, and particularly, the heel portion of the sole and that of the upper are required to have a good foot following property during the latter half of the support period. At this point, the force that acts upon the upper from the foot is a force that pushes the back side (the rear end portion) of the heel portion of the upper in the direction normal to the upper surface. Therefore, there is a demand for the back side of the heel portion of the shoe to have a structure that suppresses the deformation against such a force.

In view of this demand, in the present invention, the rear first portion and the rear second portion placed on the rear end portion of the upper increase the rigidity of the back side of the heel portion, thereby suppressing the deformation of the heel portion. This will improve the following property.

The lateral first portion L1, which is more flexurally deformable than the medial first portion M1, extends from the rear first portion B1 toward the sole 2. Therefore, the lateral first portion L1 suppresses the stretch of the heel portion lateral side in the direction that connects between the lower portion of the upper below the ankle and the rear first portion B1 without excessively increasing the flexural rigidity of the heel portion lateral side. This suppresses the deformation due to a force that pushes the back side (the rear end portion) of the heel portion of the upper in the direction normal to the upper surface. This as a result will improve the following property.

As described above, the present invention is expected to improve the stability property and the foot following property during the support period.

The rear first portion and the rear second portion increase the rigidity of the back side of the upper. In view of this, "the rear end portion of the upper", where the rear first portion and the rear second portion are placed, means an extent of 20% or less extending from the rear end of the upper with respect to the entire length (the length of the shoe in the longitudinal direction) 100% of the upper on the sagittal plane. This is because when the reinforcement device is placed in such an extent, it is possible to increase the rigidity of the back side of the upper. Therefore, it is preferred that at least a portion of the rear first portion and the rear second portion is placed in the rear end portion, which is the 20% extending from the rear end of the upper. It is preferred that at least a portion of the rear first portion is placed in an extent of 10% or less from the rear end of the upper and at least a portion of the rear second portion is placed in an extent of 20% or less. It is more preferred that at least a portion of the rear first portion is placed in an extent of 10% or less from the rear end of the upper and at least a portion of the rear second portion is placed in an extent of 15% or less. It is particularly preferred that at least a portion of the rear first portion and at least a portion of the rear second portion are both placed in an extent of 10% or less from the rear end of the upper.

The medial side refers to the side that is closer to the median on the frontal plane of the body, and is commonly referred to often as the inner side or the inner side of the foot. The lateral side refers to the side that is farther away from the median on the frontal plane of the body, and is commonly referred to often as the outer side or the outer side of the foot.

Being less flexural deformable includes cases where the flexural rigidity $\int EIz$ is higher, and also cases where the reinforcement device is formed in a loop shape and has less deformation due to bending moment.

The flexural rigidity means the integral value $\int EIz$ of the Young's modulus (longitudinal elastic modulus) E and the moment of inertia of area Iz of the member.

Each first portion and the corresponding second portion may be vertically continuous with each other or vertically separated from each other. The medial first portion and the medial second portion may have a window (through hole) therebetween, or may be continuous with each other in a flat plate shape. A lateral second portion having a thin plate shape may be provided also on the lateral side.

BRIEF DESCRIPTION OF DRAWINGS

FIG. 10A is a side view of the medial side of the rearfoot portion of a shoe according to Embodiment 2, and FIG. 10B is a side view of the lateral side of the rearfoot portion of the shoe according to Embodiment 2.

FIG. 11A is a side view of the medial side of the rearfoot portion of a shoe according to Embodiment 3, and FIG. 11B is a side view of the lateral side of the rearfoot portion of the shoe according to Embodiment 3.

FIG. 12A is a side view of the medial side of the rearfoot portion of a shoe according to Embodiment 4, FIG. 12B is a back view of the shoe according to Embodiment 4, and FIG. 12C is a side view of the medial side of the rearfoot portion of the shoe according to Embodiment 4.

FIG. 30 is a lateral side view and a medial side view showing still another example of an external heel counter.

In FIG. 1 to FIG. 6, FIG. 10A to FIG. 13A, FIG. 17 to FIG. 20A, FIG. 25A and FIG. 25B, heel counter areas are dotted.

DESCRIPTION OF EMBODIMENTS

Figure 1:
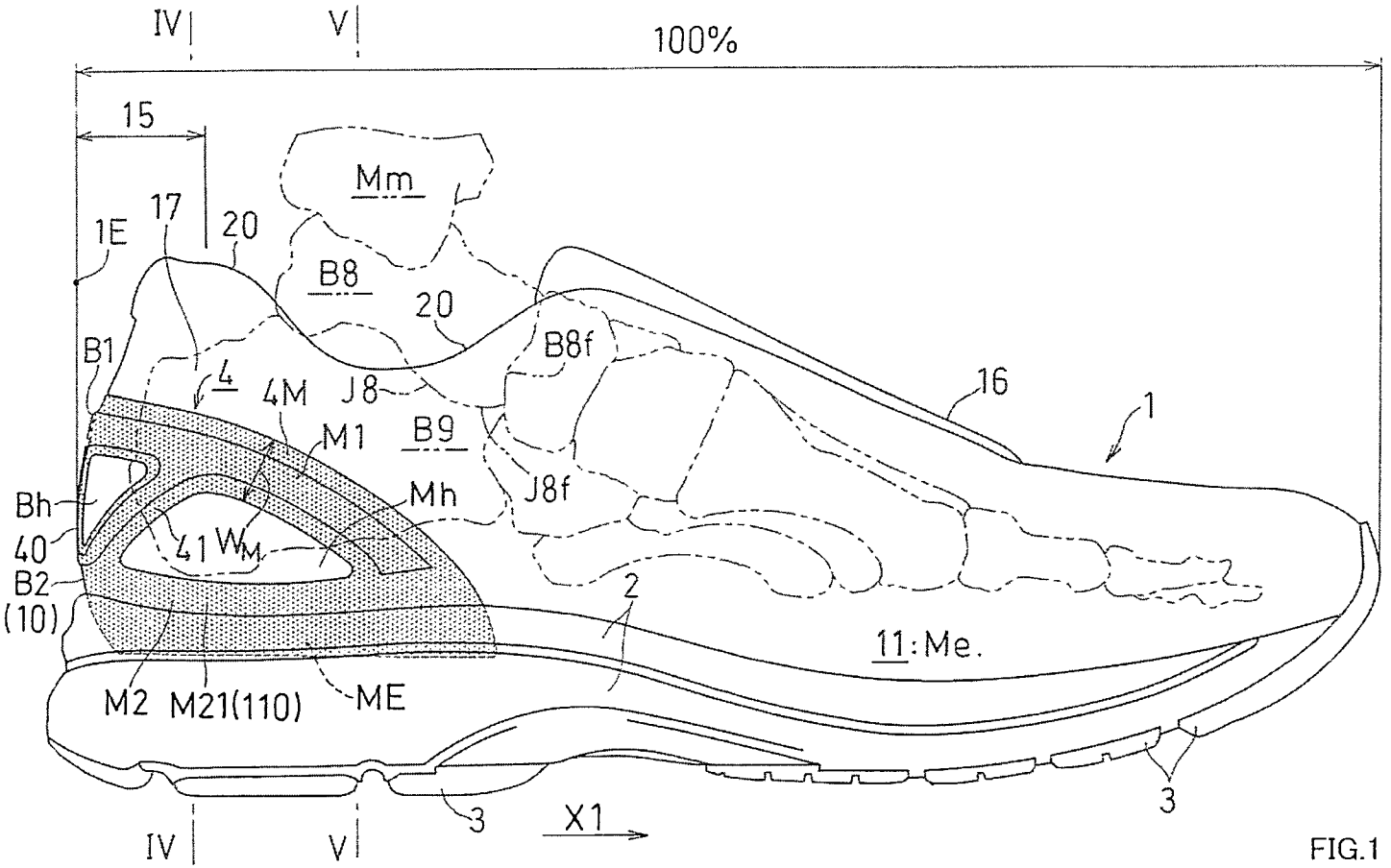
FIG. 1 is a schematic side view of the medial side showing an athletic shoe of Embodiment 1 of the present invention.

Preferably, the lateral first portion L1 extends toward the sole 2 and toward the anterior direction reaching the sole 2, the lateral first portion L1 (the reinforcement device 4) further including a lateral tucked end portion LE tucked between the sole 2 and the upper 1.

The lateral tucked end portion of the lateral first portion is tucked between the sole and the upper, and the lateral first portion increases the tensile rigidity between the lower end of the upper and the rear end portion of the upper below the lateral malleolus of the heel portion. This will improve the following property.

Preferably, the reinforcement device 4 includes a heel counter 4 made of a thermoplastic resin; and the heel counter 4 includes the rear first portion B1, the rear second portion B2, the medial first portion M1 and the medial second portion M2, which are integrally continuous with each other.

In this case, it is easy to manufacture the reinforcement device.

Preferably, the heel counter 4 further integrally (and seamlessly) includes the lateral first portion L1.

In this case, it is even easier to manufacture the reinforcement device.

Preferably, a moment of inertia of area of the medial first portion M1 is greater than a moment of inertia of area of the lateral first portion L1.

The moment of inertia of area Iz of the lateral first portion L1 is smaller than the moment of inertia of area Iz of the medial first portion M1. Therefore, it is easy to lower the flexural rigidity of the upper on the lateral side of the heel portion. As a result, the pronation will be decreased as described above.

Preferably, the lateral first portion L1 is formed from a tape material separate from the heel counter 4.

The tape material has a lower flexural rigidity than the heel counter, and gives a high tensile rigidity. Therefore, the upper on the lateral side of the heel portion has a low flexural rigidity, thereby decreasing the pronation. Since the tensile rigidity is high, a high following property will be exhibited.

Preferably, the heel counter 4 is absent (not provided) in the lateral side boundary portion 120 of the upper 1.

In this case, the flexural rigidity on the lateral side of the heel portion is low.

A shoe in another aspect of the present invention includes: an upper 1, a reinforcement device 4 reinforcing the upper 1, and a sole 2 attached to the upper 1, wherein:

the upper 1 includes a lateral side boundary portion 120 between the upper and the sole 2 on a lateral side 12 of the upper, a medial side boundary portion 110 between the upper and the sole 2 on a medial side 11 of the upper, and a rear boundary portion 10 between the upper and the sole 2 in a rear end portion 15 of the upper;

the medial side boundary portion 110 and the lateral side boundary portion 120 are continuous with each other via the rear boundary portion 10; and the reinforcement device 4 includes:

a rear first portion B1 placed between the sole 2 and a top line (a collar) 20 of the upper 1 in a rear end portion 15 of the upper;

a rear second portion B2 placed in the rear boundary portion 10;

a lateral first portion L1 being continuous with the rear first portion B1 and extending toward the sole 2 on the lateral side 12 of the upper;

a medial first portion M1 being continuous with the rear first portion B1 and extending toward the sole 2 on the medial side 11 of the upper; and a medial second portion M2 being continuous with the rear second portion B2 and extending toward an anterior direction from the rear second portion B2 along the medial side boundary portion 110 on the medial side 11 of the upper, wherein:

the lateral first portion L1 extends toward the sole 2 and toward the anterior direction reaching the sole 2, the lateral first portion L1 including a lateral tucked end portion LE tucked between the sole 2 and the upper 1;

the rear second portion B2 extends to the sole 2, the rear second portion B2 including a rear tucked end portion BE tucked between the sole 2 and the upper 1; and the medial second portion M2 includes a medial tucked end portion ME that is tucked between the sole 2 and the upper 1 and connects together the rear second portion B2 and a lower end portion of the medial first portion M1.

In this aspect, the medial second portion M2 extending along the medial side boundary portion 110 includes the medial tucked end portion ME that connects between the rear second portion B2 and the lower end portion of the medial first portion M1, and is therefore less flexural deformable as compared with the lateral side.

The reinforcement device 4 having such a structure maintains the shape of the shoe, and suppresses the pronation of the subtalar joint that occurs during the support period after landing. Therefore, it serves to support, by means of the medial side of the upper, the foot being urged to collapse toward the medial side.

The foot, which lands starting from the lateral side of the heel portion, exhibits pronation thereafter. The upper on the lateral side having the lateral tucked end portion LE is more flexurally deformable as compared with the upper on the medial side having the medial tucked end portion ME that connects together the rear second portion B2 and the lower end portion of the medial first portion M1.

That is, the lateral side boundary portion 120 is more flexurally deformable than the medial side boundary portion 110, thereby increasing the amount of deformation of the lateral side boundary portion 120 upon heel contact. As a result, it is expected to suppress the speed at which the foot collapses toward the medial side and decrease the pronation to be exhibited thereafter.

As described above, in the latter half of the support period, the rear first portion B1 and the rear second portion B2 placed in the rear end portion of the upper increase the rigidity on the back side of the heel portion, thereby suppressing the deformation of the heel portion. This will improve the following property.

The lateral first portion L1 is more flexurally deformable as compared with the medial side having the medial tucked end portion ME. The lateral first portion L1 suppresses the stretch of the heel portion lateral side in the direction that connects between the lower portion of the upper and the rear first portion B1 below the ankle without excessively increasing the flexural rigidity of the heel portion lateral side. This suppresses the deformation due to a force that pushes the back side (the rear end portion) of the heel portion of the upper in the direction normal to the upper surface. This as a result will improve the following property.

As described above, the present invention is expected to improve the stability property and the foot following property during the support period.

Preferably, the reinforcement device 4 includes a heel counter 4 made of a thermoplastic resin;

the heel counter 4 is attached to an outer surface of the upper 1; and the heel counter 4 includes a rear first portion B1, a rear second portion B2, a lateral first portion L1, a medial first portion M1 and a medial second portion M2, which are integrally and seamlessly continuous with each other.

In this case, it is easy to manufacture the reinforcement device 4.

Preferably, a rear end of the lateral tucked end portion LE and a front end of the rear tucked end portion BE are unconnected and separated from each other in an anterior-posterior direction.

In this case, the upper on the lateral side has a lower flexural rigidity as compared with the upper on the medial side having the medial tucked end portion ME. As a result, the pronation will be decreased as described above.

Preferably, the heel counter 4 includes a lateral bridge 42 that extends toward a diagonal anterior-upward direction from the rear second portion B2 to the lateral first portion L1; and a low-rigidity portion is provided between the lateral bridge 42 and the sole 2, the low-rigidity portion having a rigidity lower than that of the lateral bridge 42.

With the structure that includes a low-rigidity portion between the lateral bridge 42 and the sole 2, it is easy to lower the flexural rigidity of the lateral side boundary portion 120. Therefore, with such a structure, it is easy to decrease the pronation.

Preferably, the heel counter 4 includes a lateral bridge 42 that extends toward a diagonal anterior-upward direction from the rear second portion B2 to the lateral first portion L1; and an exposed portion 121 is provided between the lateral bridge 42 and the sole 2, and the lateral side boundary portion 120 of the upper 1 is exposed through the exposed portion 121.

With the structure in which the lateral side boundary portion 120 includes the exposed portion 121, it is easy to lower the flexural rigidity of the lateral side boundary portion 120. Therefore, with such a structure, it is easy to decrease the pronation.

Preferably, the lateral first portion L1, the lateral bridge 42, the rear second portion B2 and the sole 2 define a closed lower area α1; and the exposed portion 121 is placed in the lower area α1.

With the structure including the lateral side boundary portion 120 where the lower area α1 includes the exposed portion 121, it is easy to lower the flexural rigidity of the lower area α1. Therefore, with such a structure, it is easy to decrease the pronation.

Preferably, the lower area α1 and the exposed portion 121 are shaped so as to protrude upward.

With the structure in which the lower area α1 and the exposed portion 121 are shaped so as to protrude upward, it is easy to increase the size of the exposed portion 121. Particularly, it is easy to increase the size of the exposed portion 121 near the lateral side boundary portion 120. Therefore, with such a structure, it is easy to lower the flexural rigidity of the lateral side boundary portion 120 and decrease the pronation.

Preferably, the lateral first portion L1, the lateral bridge 42, the rear first portion B1 and the rear second portion B2 define a closed window area α2; and in the window area α2, the heel counter 4 defines a rear through hole Bh running through the heel counter 4.

With the heel counter 4 that defines the rear through hole Bh in the window area α2 on the lateral side, it is easy to lower the flexural rigidity of the upper on the lateral side of the heel portion. Therefore, the pronation will be decreased.

Preferably, the reinforcement device 4 includes a heel counter 4 made of a thermoplastic resin;

the upper 1 includes an inner skin (14) placed on a side that comes into contact with a foot, and an outer skin (13) on an opposite side of the inner skin 14;

the heel counter 4 is a built-in counter 4 that is built in between the inner skin and the outer skin; and the built-in counter 4 includes the rear first portion B1, the rear second portion B2, the lateral first portion L1, the medial first portion M1 and the medial second portion M2, which are integrally and seamlessly continuous with each other.

The built-in heel counter is sandwiched between the inner skin and the outer skin of the upper and functions as the core of the upper, and the built-in heel counter will easily serve as a heel counter despite being thin.

Preferably, the built-in counter 4 is plate-shaped as a whole and further includes a low-rigidity portion LW whose rigidity is lower than that of the medial first portion M1 and the medial second portion M2, wherein the low-rigidity portion LW is surrounded by (is bordered on) the rear first portion B1, the rear second portion B2 and the lateral first portion L1.

In this case, the low-rigidity portion LW on the lateral side, which is a surrounded area, lowers the flexural rigidity of the upper on the lateral side of the heel portion. Therefore, the pronation will be decreased as described above.

Preferably, the built-in counter 4 is plate-shaped as a whole and further includes a lateral second portion L2, the lateral second portion L2 being continuous with the rear second portion B2, and extending on the lateral side 12 of the upper along the lateral side boundary portion 120 from the rear second portion B2 toward the anterior direction;

the built-in counter 4 includes a lateral central portion LC surrounded by the rear first portion B1, the rear second portion B2, the lateral first portion L1 and the lateral second portion L2; and the lateral central portion LC defines a thin portion having a smaller thickness than surrounding portions, one or more slits, or one or more through holes.

In this case, the lateral central portion LC forms the low-rigidity portion LW, lowering the flexural rigidity of the upper on the lateral side of the heel portion. Therefore, the pronation will be decreased as described above.

Preferably, the built-in counter 4 is plate-shaped as a whole and further includes a lateral second portion L2, the lateral second portion L2 being continuous with the rear second portion B2, and extending on the lateral side 12 of the upper along the lateral side boundary portion 120 from the rear second portion B2 toward the anterior direction;

the built-in counter 4 includes a lateral central portion LC surrounded by the rear first portion B1, the rear second portion B2, the lateral first portion L1 and the lateral second portion L2;

the built-in counter 4 includes a medial central portion MC surrounded by the rear first portion B1, the rear second portion B2, the medial first portion M1 and the medial second portion M2; and a thickness of the lateral central portion LC is smaller than a thickness of the medial central portion MC.

With the structure in which the thickness of the lateral central portion LC is smaller than the thickness of the medial central portion MC as described above, the flexural rigidity of the lateral central portion LC is lower than the flexural rigidity of the medial central portion MC. Therefore, such a structure will lower the flexural rigidity of the upper on the lateral side of the heel portion and decrease the pronation as described above.

Preferably, the built-in counter 4 is plate-shaped as a whole and includes a medial portion 4M placed on a medial side and a lateral portion 4L placed on a lateral side, which are seamlessly continuous with each other; and an average thickness of the lateral portion 4L is smaller than an average thickness of the medial portion 4M.

With the thin structure, the flexural rigidity of the lateral portion 4L is lower than the flexural rigidity of the medial portion 4M. Therefore, such a structure will lower the flexural rigidity of the upper on the lateral side of the heel portion and decrease the pronation as described above.

Preferably, the lateral central portion LC includes a plurality of through holes arranged in a scattered pattern.

The lateral central portion LC having a plurality of through holes forms the low-rigidity portion LW, lowering the flexural rigidity of the upper on the lateral side of the heel portion. Therefore, the pronation will be decreased as described above.

Preferably, the lateral central portion LC defines a plurality of slits extending in an anterior-posterior direction.

The lateral central portion LC defining a plurality of slits forms the low-rigidity portion LW, lowering the flexural rigidity of the upper on the lateral side of the heel portion. Therefore, the pronation will be decreased as described above.

Preferably, the built-in counter 4 is plate-shaped as a whole with a lower edge; and the lower edge is formed in an upward arch shape between the lateral tucked end portion LE and the rear tucked end portion BE.

With the structure in which the lower edge of the built-in counter is formed in an upward arch shape on the lateral side, the lateral side boundary portion 120 is more flexurally deformable than the medial side boundary portion 110. Therefore, the pronation will be decreased as described above.

Preferably, the shoe further includes an external counter attached to an outer surface of a rearfoot portion of the upper 1.

When an additional external counter is provided in addition to the built-in counter 4 having the function as described above, it is possible to realize the function-oriented structure of the built-in counter 4 and the design-oriented structure of the external counter. Therefore, it will be advantageous in two ways, i.e., for the function and for the design.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

EMBODIMENTS

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Embodiments of the present invention will now be described with reference to the drawings.

Embodiment 1

FIG. 1 to FIG. 5 show Embodiment 1.

Figure 2:
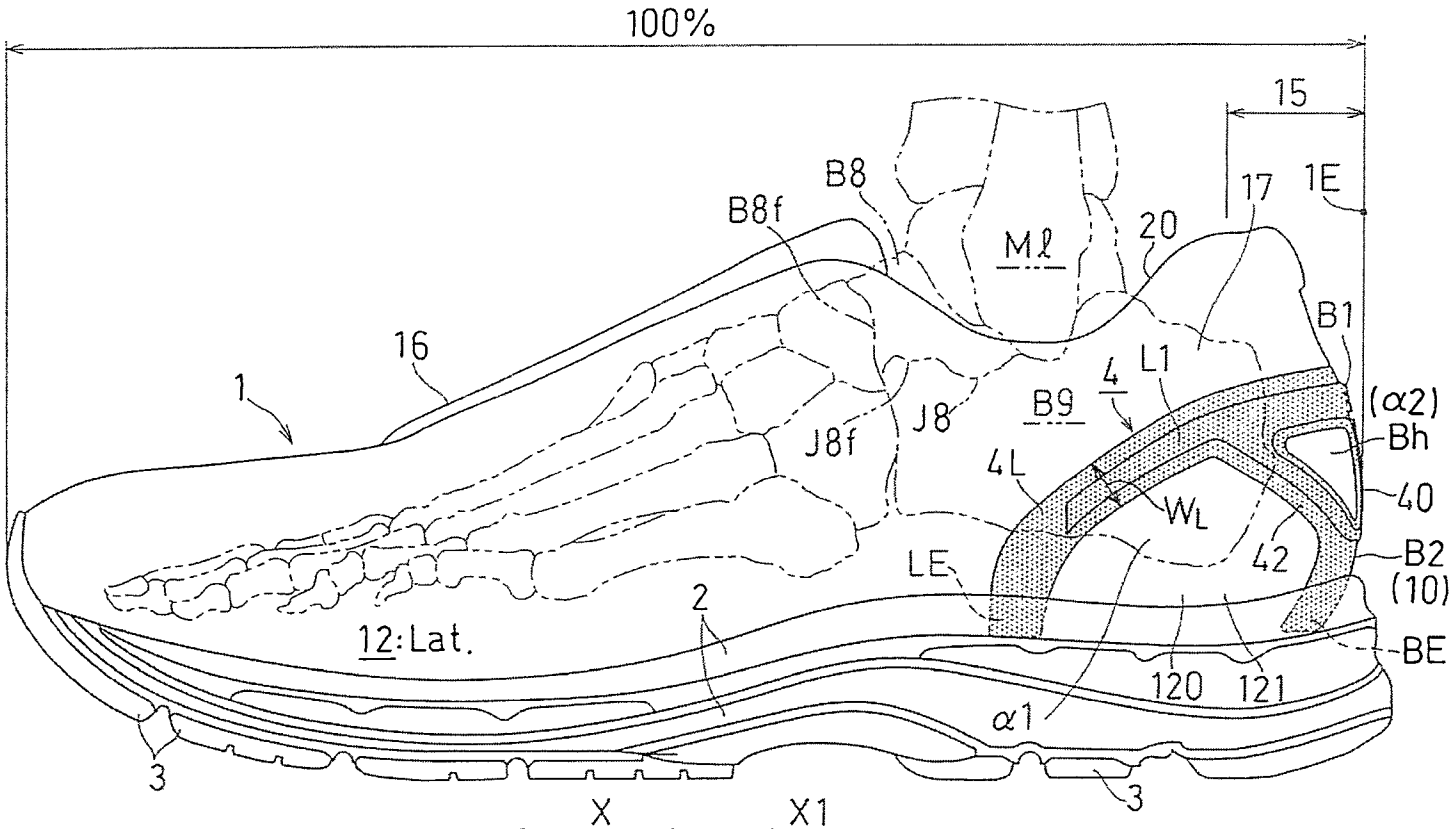
FIG. 2 is a schematic side view of the lateral side showing the athletic shoe of Embodiment 1.
Figure 3:
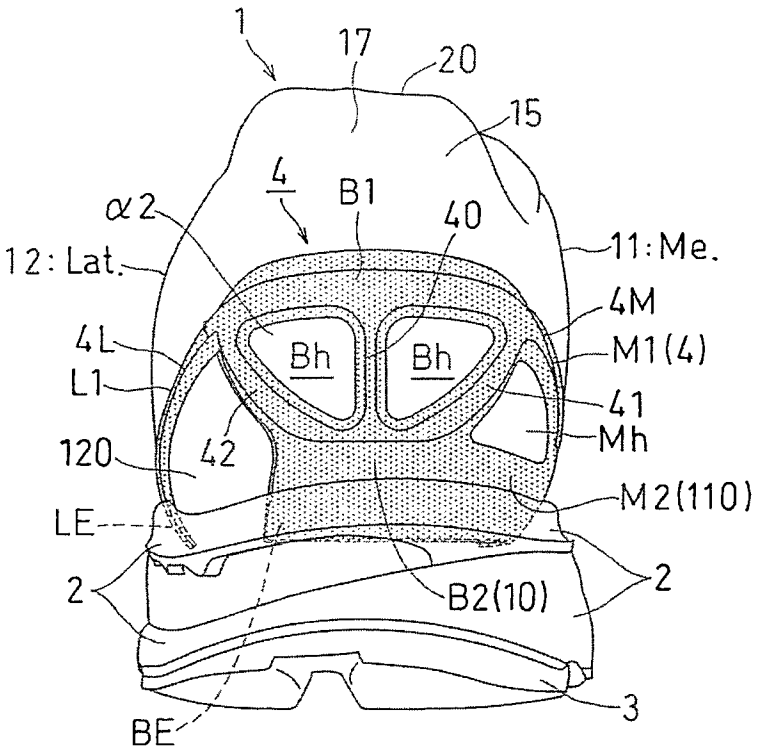
FIG. 3 is a back view showing the athletic shoe of Embodiment 1.

General Configuration:

As shown in FIG. 1 to FIG. 3, the present athletic shoe includes an upper 1, a midsole 2, an outsole 3 and a heel counter (reinforcement device) 4.

Figure 4:
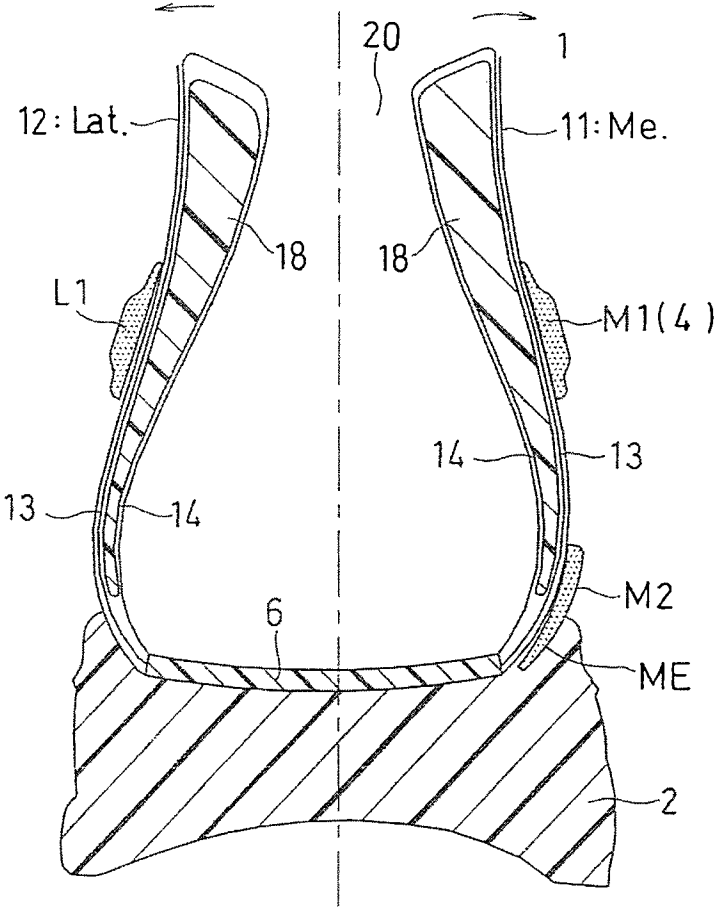
FIG. 4 is a IV-IV cross section of an upper according to Embodiment 1.

As shown in FIG. 4, the upper 1 includes a cushioning material 18 made of a foamed resin between a quarter 13 and a quarter lining 14. Note that the quarter 13 and the quarter lining 14 may be formed from a plurality of layers of fabric.

An insole 6 is sewn onto the upper 1. On the other hand, the upper 1 of FIG. 1 includes a top line 20 through which the leg extends upward and through which the foot is inserted.

The upper 1 includes a fastening means such as a shoelace (not shown). The shoelace fastens the upper 1 so that a medial side 11 of the upper 1 and a lateral side 12 of FIG. 2 are brought into close contact with the foot in the vicinity of the top line 20. The reference numeral 16 denotes a tongue provided in front of the top line 20.

The medial side 11 of the upper 1 covers the medial surface of the foot. The lateral side 12 of the upper 1 covers the lateral surface of the foot. A rear end portion 15 of the upper 1 covers the back surface of the foot. The medial side 11, the lateral side 12 and the rear end portion 15 of the upper 1 together form the top line 20.

In the vicinity of the top line 20 of the upper 1, the medial side 11 of the upper 1 of FIG. 1 covers the front end portion B8*f* of the talus bone B8 and the front end portion J8*f* of the subtalar joint J8. On the other hand, the lateral side 12 of the upper 1 of FIG. 2 covers the front end portion B8*f* of the talus bone B8 and the front end portion J8*f* of the subtalar joint J8. In the present embodiment, a part of the lateral malleolus Ml and the medial malleolus Mm of FIG. 1 may each be exposed above the top line 20.

As shown in FIG. 4A, the heel counter 4 is bonded and secured with no gap to the outer surface of the upper 1 on the medial side 11 and the lateral side 12 of the upper 1. The upper 1 with the heel counter 4 bonded to the outer surface thereof as described above has a high flexural rigidity and serves to suppress the pronation.

The midsole 2 and the outsole 3 of FIG. 1 are stacked together below the heel counter 4 and the insole 6.

Heel Counter 4:

Next, the heel counter 4, which is a reinforcement device, will be described. In FIG. 1 to FIG. 5, the heel counter 4 is dotted.

The heel counter 4 shown in FIGS. 1 to 3 is bonded to, and partially exposed on, the outer surface of the fabric of the upper 1 to maintain the shape of a heel portion 17 of the soft upper 1, which includes a plurality of layers of fabric and is soft. The counter 4 includes the medial portion 4M placed on the medial side and the lateral portion 4L placed on the lateral side, which are integrally and seamlessly continuous with each other.

The heel counter 4 is formed integrally from a material that includes a thermoplastic resin component.

As shown in FIG. 1 to FIG. 3, the medial portion and the lateral portion of the heel counter 4 are formed asymmetric with each other. The heel counter 4 forms a part or whole of the reinforcement device. The heel counter 4 includes a lateral tucked end portion LE, a rear tucked end portion BE and a medial tucked end portion ME to be described later.

The heel counter 4 of FIG. 3 is made of a thermoplastic resin, and includes a rear first portion B1, a rear second portion B2, a lateral first portion L1, a medial first portion M1 and a medial second portion M2, which are formed integrally continuous with each other. The heel counter 4 integrally includes three bridges 40 to 42, for example.

As clearly shown in FIG. 1 and FIG. 3, in the rear end portion 15 of the upper, the rear first portion B1 is placed between the midsole 2 and the top line 20 of the upper 1. The second portion B2 is placed along the boundary portion 10 between the rear end portion 15 of the upper 1 and the midsole 2. Moreover, the rear second portion B2 extends to the midsole 2, and includes the rear tucked end portion BE that is tucked between the midsole 2 and the upper 1. The bridge 40 on the rear center portion of FIG. 3 vertically connects between the center of the rear first portion B1 and the center of the rear second portion B2. That is, the bridge 40 is placed directly behind the calcaneal bone B9 of FIG. 1.

As shown in FIG. 1 and FIG. 2, the rear end portion 15 of the upper 1 is an extent of 20%, preferably 10%, extending from a rear end 1E of the upper with respect to the entire length 100% of the upper on the sagittal plane. In the rear end portion 15, the rear first portion B1 and the rear second portion B2 of FIG. 3 extend in the lateral direction while being curved along the upper.

In the rear end portion 15 on the medial side of FIG. 1, the medial bridge 41 diagonally connects between the rear first portion B1 and the rear second portion B2. On the other hand, in the rear end portion 15 on the lateral side of FIG. 2, the lateral bridge 42 diagonally connects between the rear first portion B1 and the rear second portion B2. A rear through hole Bh, which appears to be a window, may be provided between the three bridges 40 to 42, as shown in FIG. 3.

The lateral first portion L1, the lateral bridge 42, the rear first portion B1 and the rear second portion B2 define a closed window area $\alpha 2$, and the heel counter 4 defines the rear through hole Bh running through the heel counter 4 in the window area $\alpha 2$.

On the lateral side 12 of FIG. 2, the lateral first portion L1 extends toward the midsole 2 below and toward the diagonal anterior direction reaching the midsole 2. The heel counter 4 includes the lateral tucked end portion LE that is tucked between the midsole 2 and the upper 1.

The lateral tucked end portion LE is formed by the lateral first portion L1 extending toward the midsole 2 and toward the anterior direction X1 reaching the midsole 2 so as to be tucked between the midsole 2 and the upper 1.

On the lateral side 12, the heel counter 4 is not placed in the lateral side boundary portion 120 of the upper 1. In the case of the present embodiment, the lateral side boundary portion 120 includes an exposed portion 121 that is exposed and not covered by the heel counter 4.

The lateral first portion L1, the lateral bridge 42, the rear second portion B2 and the midsole 2 define a closed lower area $\alpha 1$, and the exposed portion 121 is placed in the lower area $\alpha 1$.

Note that the lateral side boundary portion 120 means the vicinity of the boundary between the lateral side 12 of the upper 1 and the midsole 2.

On the medial side 11 of FIG. 1, the medial first portion M1 extends toward the midsole 2 below and toward the diagonal anterior direction reaching the midsole 2, and is continuous with the medial second portion M2. On the medial side 11 of the upper, the medial second portion M2 extends toward the anterior direction from the rear second portion B2 along the medial side boundary portion 110 to be continuous with the medial first portion M1.

A medial through hole Mh, which appears to be a window, may be provided between the medial first portion M1 and the medial second portion M2 which are arranged in the vertical direction.

Note that the medial side boundary portion 110 means the vicinity of the boundary between the medial side 11 of the upper 1 and the midsole 2.

Figure 5:
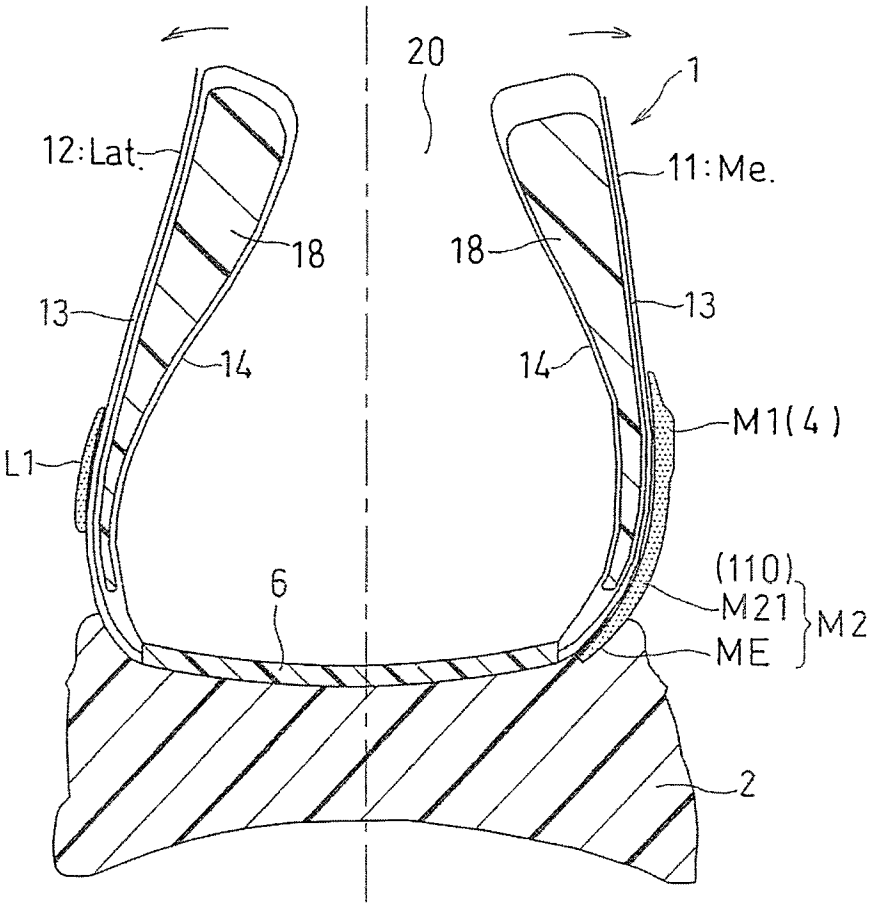
FIG. 5 is a V-V cross section of the upper according to Embodiment 1.

As shown in the cross sections of FIG. 4 and FIG. 5, the medial tucked end portion ME, which generally is a lower half of the medial second portion M2, is tucked between the midsole 2 and the upper 1. The tucked end portion ME is the medial second portion M2 tucked between the sole 2 and the upper 1, and connects together the rear second portion B2 and the lower end portion of the medial first portion M1. On the other hand, an exposed portion M21, which generally is an upper half of the medial second portion M2 of FIG. 1, covers the medial side boundary portion 110 of the upper 1 and is exposed.

Regarding the flexural deformation that occurs when the upper collapses in the arrow directions of FIG. 4 and FIG. 5, the value of the flexural rigidity $\int EIz$ of the medial first portion M1 is greater than the value of the flexural rigidity $\int EIz$ of the lateral first portion L1. In the case of the present embodiment, regarding the flexural deformation, the value of the moment of inertia of area Iz of the medial first portion M1 is greater than the value of the moment of inertia of area Iz of the lateral first portion L1. For example, the thickness of the medial first portion M1 of FIG. 5 is greater than the thickness of the lateral first portion L1.

With such flexural deformation, the moment of inertia of area Iz has such a correlation that it is in proportion to the cube of the thickness.

In the case of the present embodiment, the medial first portion M1 and the lateral first portion L1 of FIG. 3 are formed from the same material. Therefore, the medial first portion M1 and the lateral first portion L1 have an equal Young's modulus (longitudinal elastic modulus) E.

The medial second portion M2 is placed on the medial side boundary portion 110 of FIG. 1, whereas a member that corresponds to the medial second portion M2 (FIG. 1) is not placed on the lateral side boundary portion 120 of FIG. 2. That is, the medial second portion M2 is placed on the medial side boundary portion 110 of FIG. 1 so that the medial side boundary portion 110 of FIG. 1 is less flexural deformable than the lateral side boundary portion 120 of FIG. 2.

On the medial side 11 of FIG. 1, the medial first portion M1, the medial second portion M2 and the bridge 41 are formed to be continuous with each other in a loop shape. The loop-shaped portion increases the average flexural rigidity of the lower portion of the upper from the rear end of the talus bone B8 to the front end of the lateral malleolus Ml (FIG. 2). The loop-shaped heel counter 4 of FIG. 1 makes the medial first portion M1 less flexurally deformable than the lateral first portion L1 of FIG. 2.

Next, a test that was conducted to verify the validity of the present invention will be described. For this purpose, first, samples of Types 1 to 5 shown in FIG. 6 were prepared.

Figure 6:
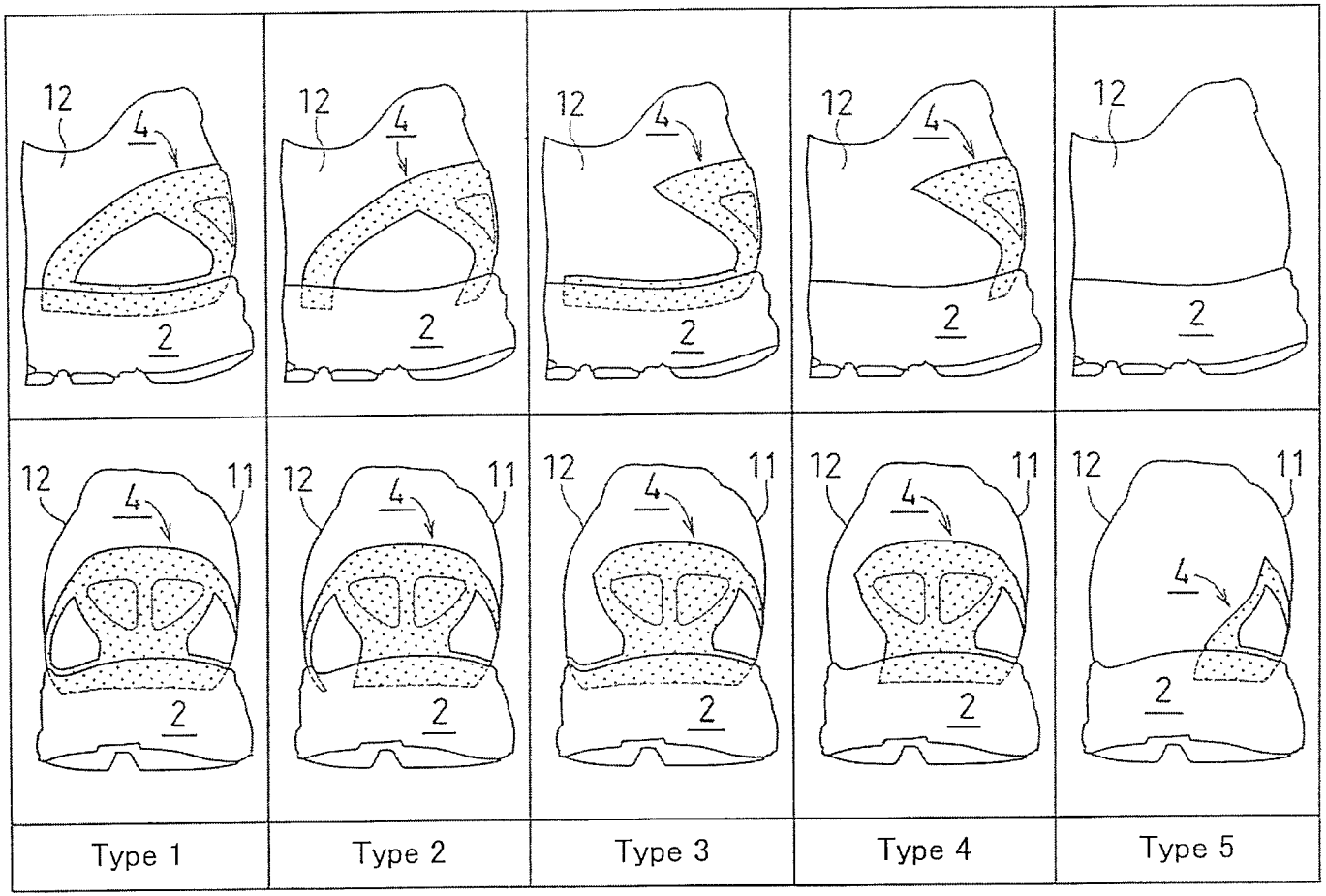
FIG. 6 is a side view and a back view of the lateral side showing 5 types of shoes used in a test.

The shoe of Type 1 of FIG. 6 includes a heel counter that has generally the same shape on the medial side and on the lateral side. The lateral side and the medial side of Type 1 have a similar structure to that of the medial side of the heel counter of Embodiment 1. That is, the rigidity of the heel portion of the upper of Type 1 is generally the same on the medial side and on the lateral side.

The shoes of Types 2 to 5 were made by partially cutting off the lateral portion and the back portion of the heel counter of Type 1. Note that the medial portions of the shoes of Types 2 to 5 are similar to those of the heel counter of Type 1.

The heel counter of Type 2 is obtained by being cut off at the lateral side boundary portion 120 (FIG. 2) between the upper of the heel portion lateral side and the midsole 2.

The heel counter of Type 3 is obtained by partially cutting off the lateral side while leaving at the lateral side boundary portion 120 (FIG. 2), the rear first portion and the rear second portion.

The heel counter of Type 4 is obtained by cutting off most of the lateral side while leaving the rear first portion and the rear second portion.

The heel counter of Type 5 is obtained by cutting off most of the rear first portion and the entire lateral side.

The pronation (the heel portion eversion angle ß and the lower leg internal rotation angle γ) and the heel portion holding property (the evaluation value Disp.Z of the foot following property during the latter half of the support period) were measured while actually running. The results are shown in FIG. 7 to FIG. 9.

The evaluation value Disp.Z of the following property is the vertical displacement of the foot with respect to the shoe. Therefore, the maximum value of Disp.Z, which is observed during heel rise, is measured as the evaluation value Disp.Zmax, wherein the value being smaller means a better following property and a higher heel portion holding property.

Figure 7:
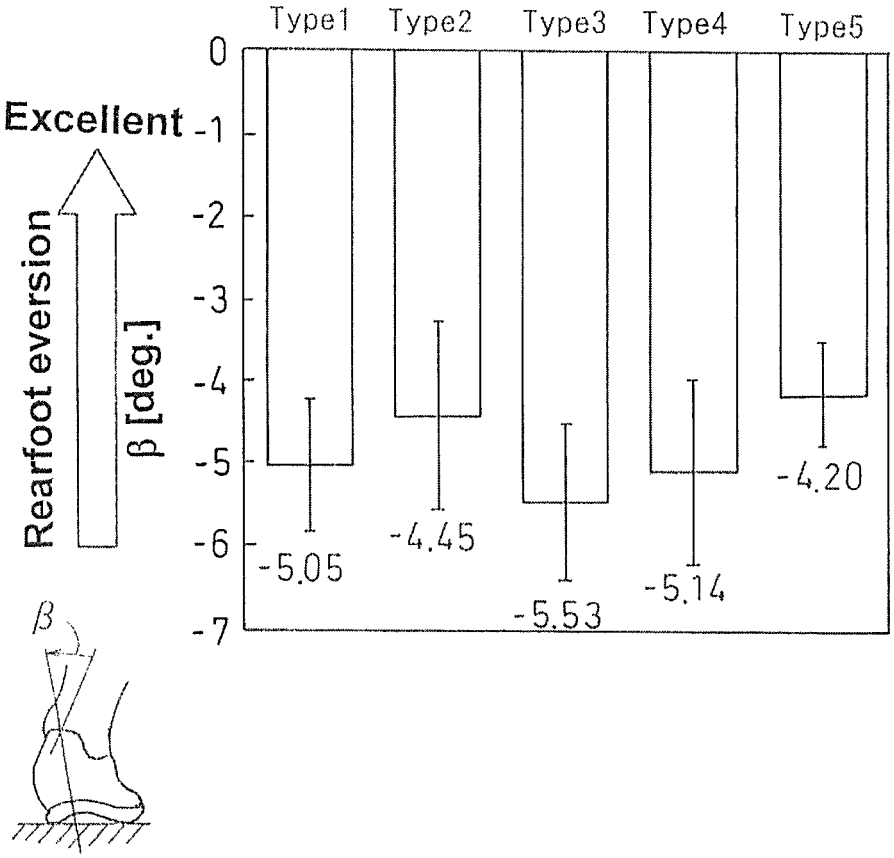
FIG. 7 is a bar graph showing the measurement result of the heel eversion angle ß after landing.
Figure 8:
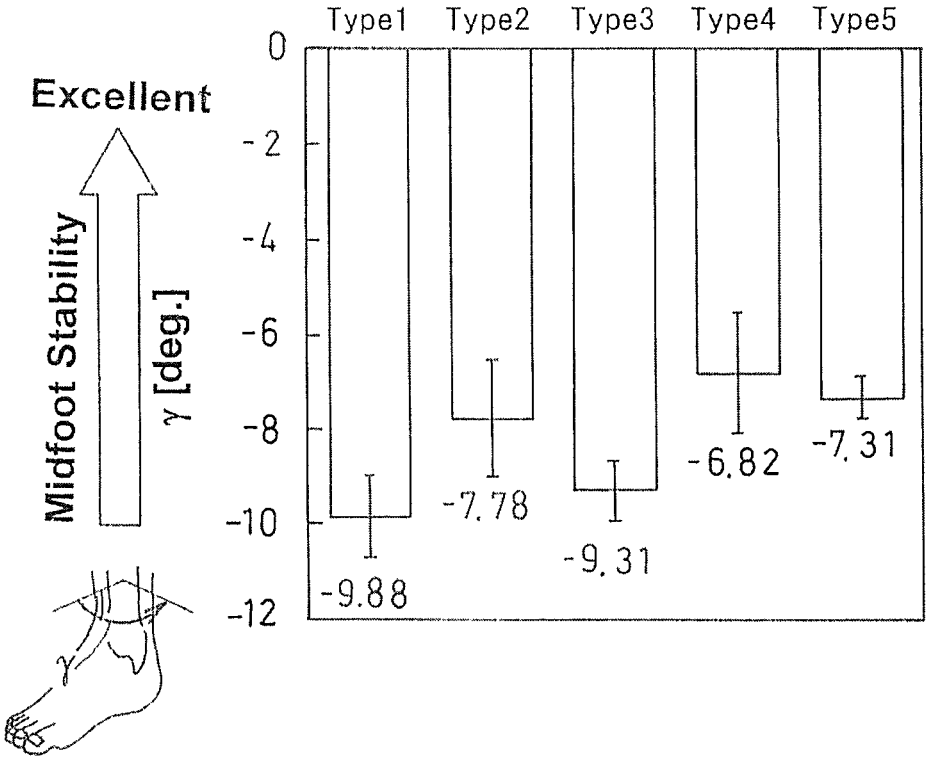
FIG. 8 is a bar graph showing the measurement result of the lower leg internal rotation angle (the lower leg inversion angle) γ after landing.
Figure 9:
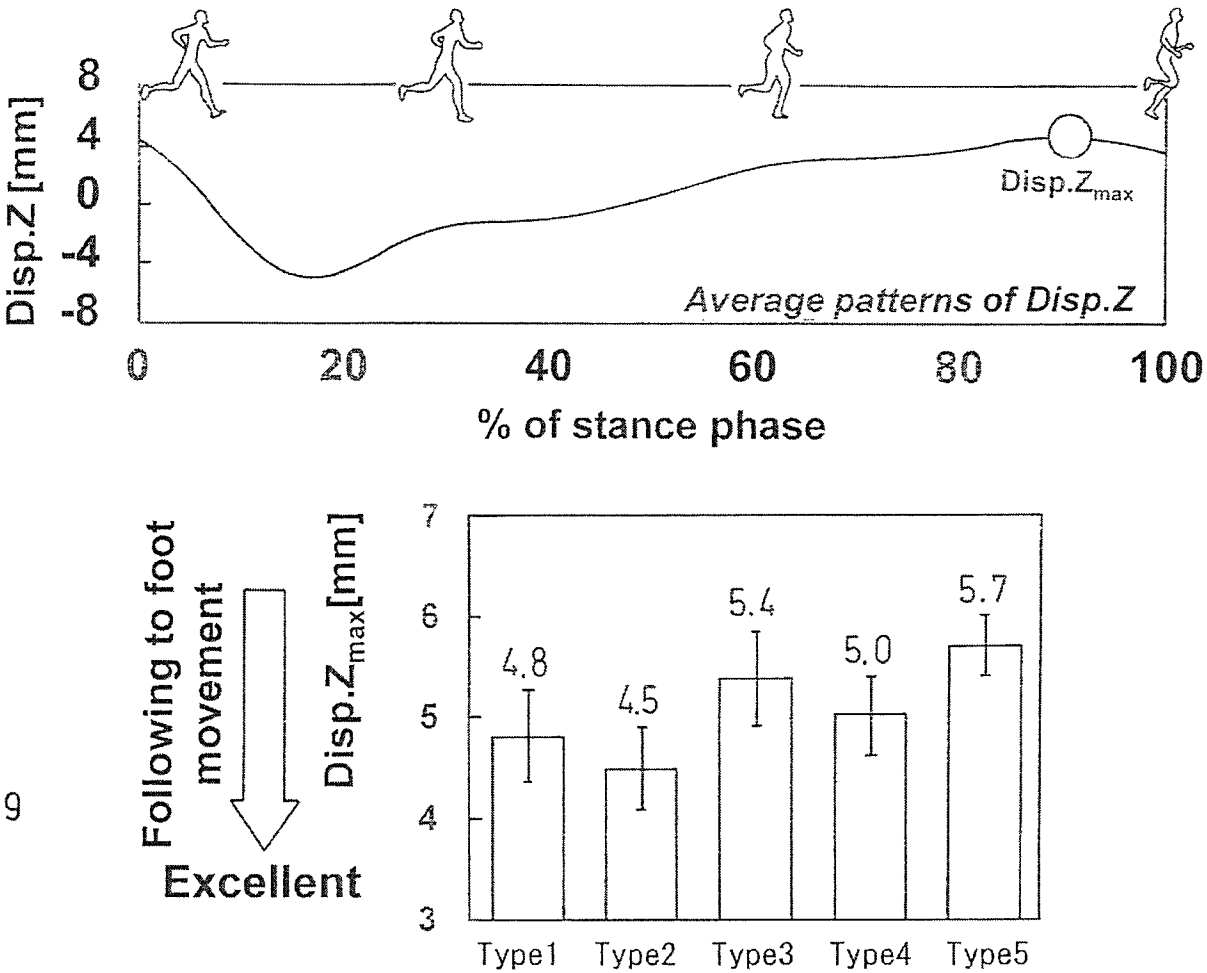
FIG. 9 is graphs showing the measurement method and the measurement result of the displacement of the heel with respect to the shoe.

It was confirmed that for the heel portion eversion angle ß of FIG. 7, Type 2 and Type 5 have smaller absolute values than Type 1, and for the lower leg internal rotation angle γ of FIG. 8, Type 2, Type 4 and Type 5 have smaller absolute values than Type 1, i.e., an improvement in the stability property.

With the shoe of Type 1 of FIG. 6, the heel counter is present in the lateral side boundary portion 120 (FIG. 2) of the heel portion lateral side, where the sole first comes into contact with the ground.

In contrast, the samples of Types 2, 4 and 5 with an improved stability property described above are obtained by the heel counter being cut off at the lateral side boundary portion 120 (FIG. 2). The low rigidity of the lateral side boundary portion 120 (FIG. 2) increases the deformation of the sole upon landing. It is believed that this suppresses the speed at which the foot collapses toward the medial side and decreases the pronation to be exhibited thereafter. That is, it is believed that the absolute value of the heel portion eversion angle ß of FIG. 7 and the absolute value of the lower leg internal rotation angle γ of FIG. 8 are small, thereby improving the stability property.

As described above, it can be seen that in order to improve the stability property, it is important to lower the rigidity of the lateral side boundary portion 120 of FIG. 2.

For the following property of FIG. 9, i.e., the heel portion holding property, it can be seen that the evaluation value Disp.Zmax of the following property for Type 3, Type 4 and Type 5 is increased as compared with Type 1, thereby resulting in a poor heel portion holding property.

With the shoes of Type 3, Type 4 and Type 5 of FIG. 6, most of the heel counter is cut off on the lateral side, thereby lowering the tensile rigidity of the heel portion lateral side. During the dorsiflex phase of the upper, a force that pushes the heel portion of the upper acts in the direction normal to the upper surface, thereby causing a stretch deformation in the area of the heel portion lateral side. It is believed that with the shoes of Type 3, Type 4 and Type 5, the heel portion holding property is lowered because the cut-off allows the deformation.

Moreover, with the shoe of Type 5, the counter is cut off not only on the lateral side but also on the back side, thereby lowering the flexural rigidity of an area upon which a force acts directly. It is believed that the heel portion deformation is thus greater as compared with Type 3 and Type 4, resulting in the lowest heel portion holding property among all the samples.

As described above, it can be seen that in order to improve the heel portion holding property, it is important to increase the tensile rigidity of an area that connects together the lateral side and the back portion of the heel portion and the rigidity of the back portion of the heel portion.

Figure 14:
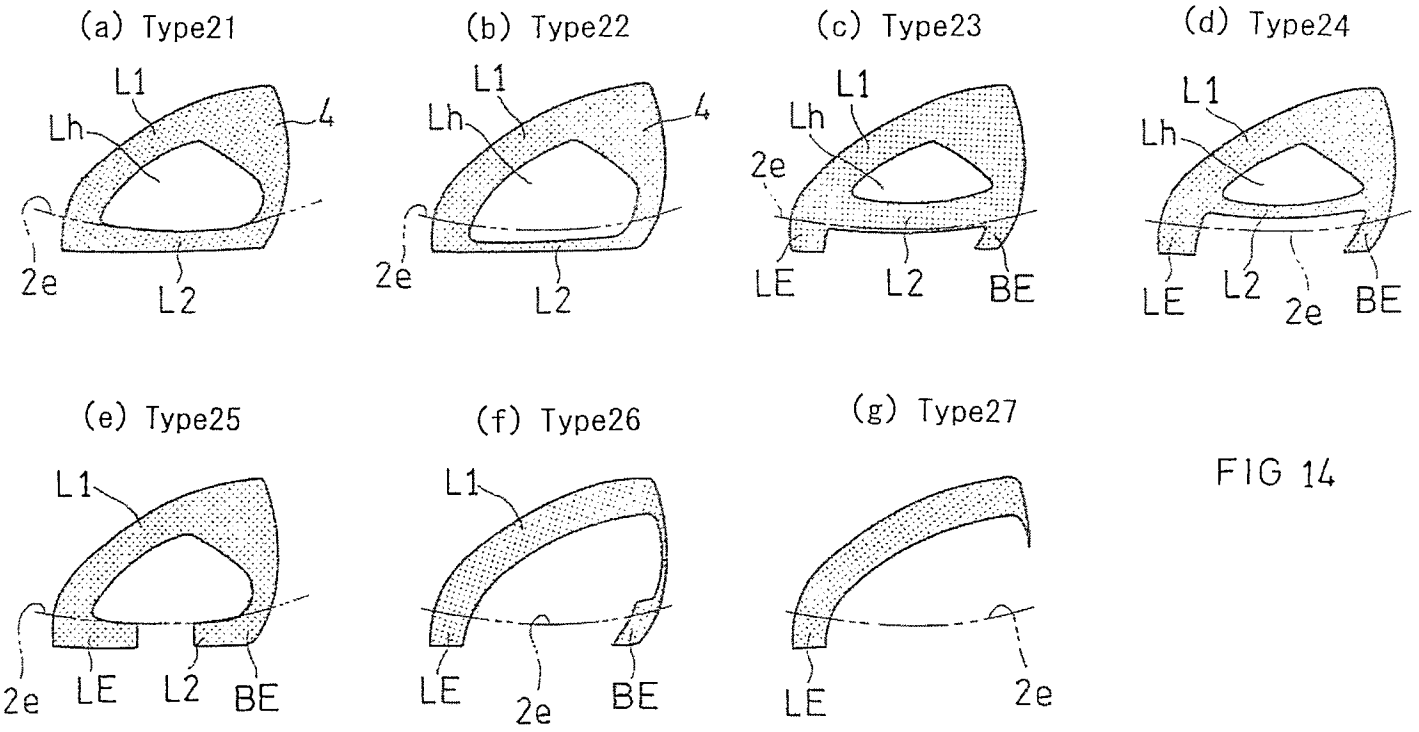
FIG. 14 is a side view of the lateral side showing other seven types of heel counters used in a test.

Next, another test that was conducted to verify the validity of the present invention will be described. For this purpose, samples of Types 21 to 27 shown in FIG. 14 were prepared. These samples have similar medial sides to those of the samples of FIG. 6. FIG. 14 shows the lateral side of the heel counter.

The heel counters of Type 21 of FIG. 14(*a*) and Type 22 of FIG. 14(*b*) are provided with a lateral through hole Lh that is larger than the medial through hole Mh (FIG. 1).

With the sample of Type 21 of FIG. 14(*a*), the lower end of the lateral through hole Lh is set to be generally at the midsole upper edge 2*e*.

With the sample of Type 22 of FIG. 14(*b*), the lower end of the lateral through hole Lh is set to be below the midsole upper edge 2*e*.

The heel counters of Types 23 and 24 of FIGS. 14(*c*) and 14(*d*) have the lateral second portion L2 that connect together the lateral tucked end portion LE and the rear tucked end portion BE.

With the heel counter of Type 23, the lower end of the lateral second portion L2 is set to be around the midsole upper edge 2*e*.

With the heel counter of Type 24, the lower edge of the lateral second portion L2 is set to be above the midsole upper edge 2*e*.

The heel counter of Type 25 of FIG. 14(*e*) is obtained by cutting off about ⅓ of the central portion of the lateral second portion L2 of the heel counter of Type 21 of FIG. 14(*a*).

The heel counter of Type 26 of FIG. 14(*f*) has a structure obtained by cutting off a rear upper portion on the lateral side of the heel counter of Type 2 of FIG. 6.

The heel counter of Type 27 of FIG. 14(*g*) has a structure obtained by partially cutting off a rear upper portion and a rear second portion on the lateral side of the heel counter of Type 2 of FIG. 6.

The heel portion eversion angle ß was measured while actually running. The results are shown in FIG. 15 and FIG. 16.

Figure 15:
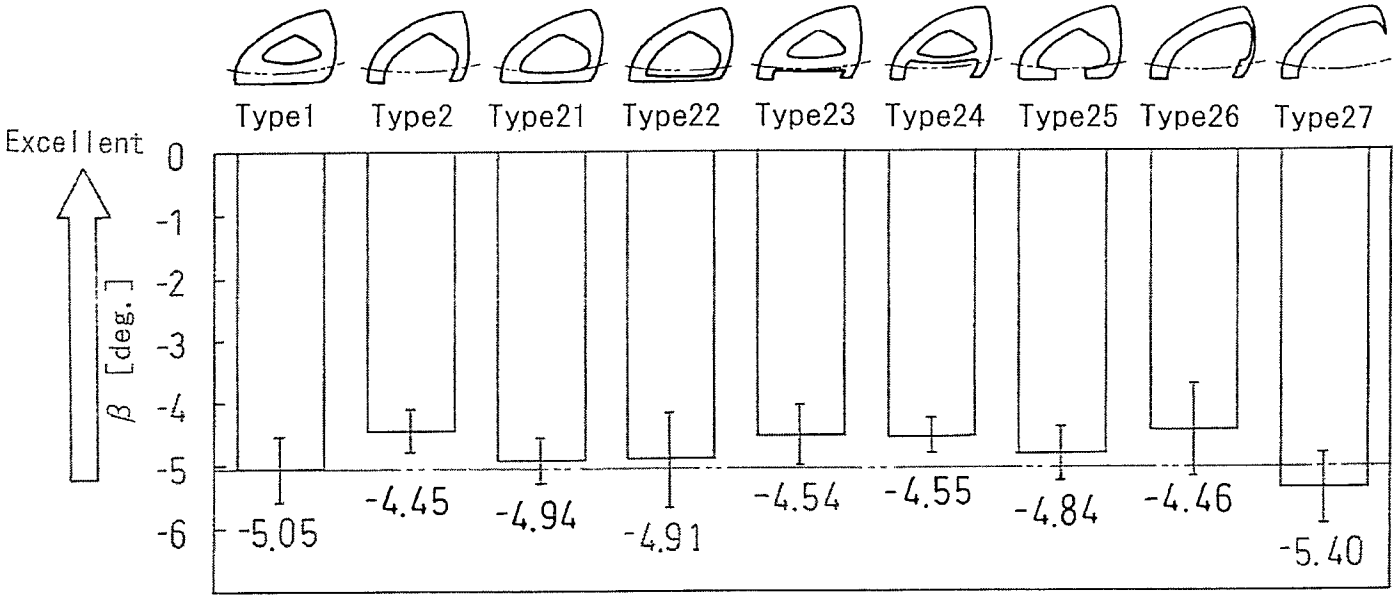
FIG. 15 is a bar graph showing the measurement result of the heel eversion angle ß after landing from the test.

In FIG. 15, it can be understood that with Types 21 to 26, excluding Type 27, the heel portion eversion angle ß is smaller than Type 1, as with Type 2.

Figure 16:
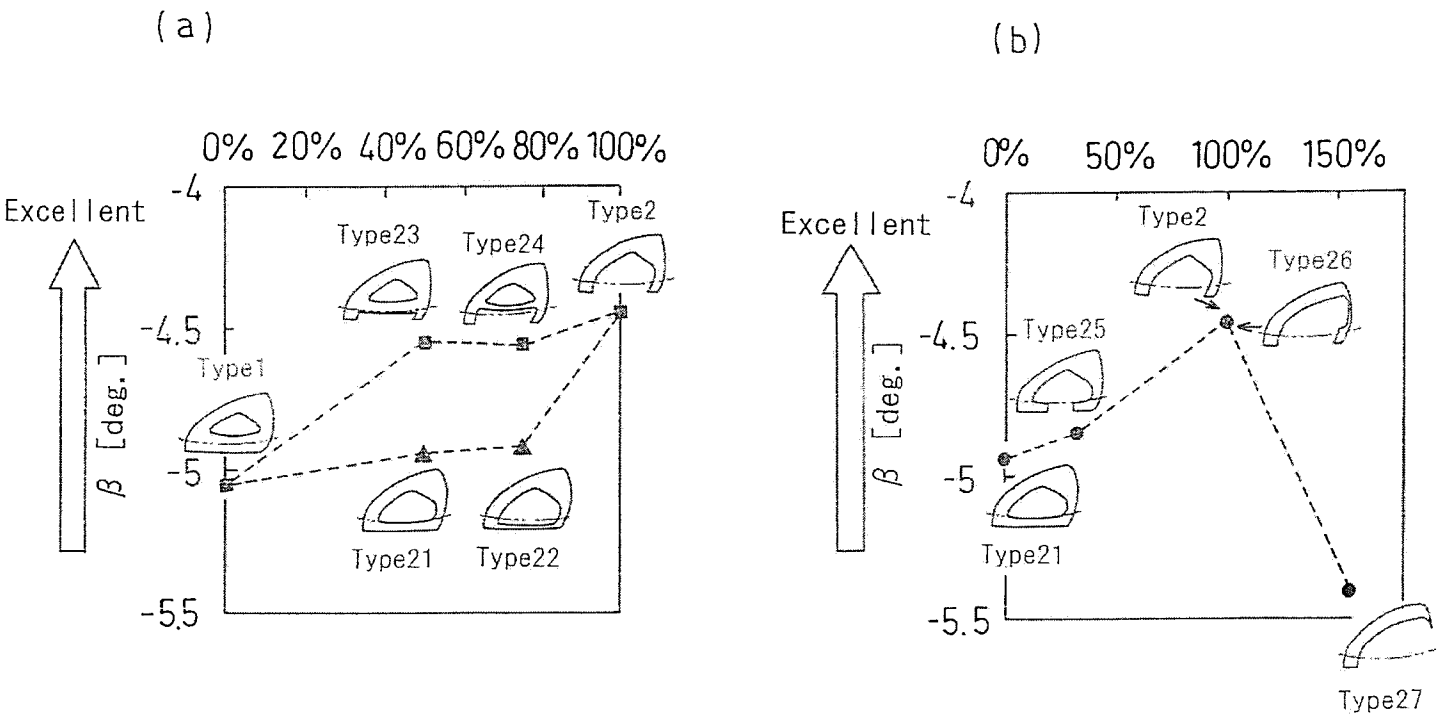
FIG. 16 shows the relationship between the cut-off percentage in the vertical direction or the foot longitudinal direction and the angle ß.

FIGS. 16(*a*) and 16(*b*) show the heel portion eversion angle ß for the various samples, wherein the horizontal axis of the graphs represents the cut-off percentage in the vertical direction and the foot longitudinal direction, respectively, of the lateral second portion L2 (FIG. 14).

In the graph of FIG. 16(*a*), it can be seen that the heel counters of Types 23 and 24, where even though the lateral second portion L2 (FIG. 14) is provided, the lateral second portion L2 is not tucked by the midsole, have generally the same heel portion eversion angle ß as that of the heel counter of Type 2. That is, also with Types 23 and 24, the stability property will improve, as with Type 2.

In the graph of FIG. 16(*b*), it can be seen that from a comparison between Types 25 and 26 and Types 1 and 2, as the cut-off percentage of the lateral second portion L2 (FIG. 14) is greater, the absolute value of the heel portion eversion angle ß is smaller, thereby improving the stability property.

However, it can be seen that when a large portion of the rear tucked end portion BE (FIG. 14) is cut off, as with Type 27 of FIG. 16(*b*), the absolute value of the heel portion eversion angle ß will be greater than Type 21, lowering the stability property.

Next, other embodiments will be described.

FIG. 10A and FIG. 10B show Embodiment 2.

In FIG. 10A and FIG. 10B, the quarter 13 of the upper includes a main member 13*a* and a reinforcement member 13*b*. The main member 13*a* is placed over more than a half or most of the quarter 13, covering the medial side and the lateral side of the foot. The reinforcement member 13*b* is provided in the hatched area of the quarter 13, for example, and may be stacked on the surface of the main member 13*a* or may be provided by impregnating the main member 13*a* with a resin.

The main member 13*a* may be, for example, a mesh material having a lattice structure (mesh structure), a knit fabric, a woven fabric, or the like. These materials are more stretchable than the reinforcement member 13*b*.

The reinforcement member 13*b* of the medial side 11 of FIG. 10A is placed along the medial first portion M1 of the heel counter 4. On the other hand, the reinforcement member 13*b* of the lateral side 12 of FIG. 10B forms a part of the reinforcement device, and forms the lateral first portion L1 together with the heel counter 4.

In FIG. 10B, the reinforcement member 13*b* of the lateral side 12 is placed on the lateral side boundary portion 120. The reinforcement member 13*b* of the lateral side boundary portion 120 forms the lateral second portion L2. Therefore, the lateral side boundary portion 120 has a higher tensile rigidity than a portion where only the main member 13*a* is placed, and has a lower flexural rigidity than the medial side boundary portion 110 of FIG. 10A.

The heel counter 4 of FIG. 10A and FIG. 10B is not provided with a bridge on the rear center portion. The lateral first portion L1 of the heel counter 4 extends toward the midsole 2 toward the anterior direction, but does not extend up to the midsole 2.

The width $W_L$ of the lateral first portion L1 of the heel counter 4 is greater than the width $W_M$ of the medial first portion M1. However, the lateral first portion L1 of the heel counter 4 has a free end on the front side of the rear end portion 15. Therefore, on the front side of the rear end portion 15, the lateral first portion L1 of the heel counter 4 is more flexurally deformable than the medial first portion M1 of FIG. 10A.

The bridges 41 and 42 of the medial side 11 and the lateral side 12 support the rear first portion B1, and therefore the compressive rigidity of the rear end portion 15 of the upper is high.

FIG. 11A and FIG. 11B show Embodiment 3.

As in the present embodiment, the reinforcement member 13*b* may be provided only on the lateral side 12.

In the present embodiment, the heel counter 4 is formed in a loop shape on the medial side 11 and the lateral side 12. Also in the present embodiment, the lateral first portion L1 is formed by the heel counter 4 and the reinforcement member 13*b*. The lower portion of the lateral first portion L1 and the lateral side boundary portion 120 are formed from the reinforcement member 13*b* of the upper, and therefore the lateral first portion L1 is more flexurally deformable than the medial first portion M1.

FIG. 12A to FIG. 12C show Embodiment 4.

The heel counter 4 of the present embodiment is formed from a tape material. The heel counter 4 of the tape material may be bonded and sewn onto the main member of the quarter 13.

The tape material has a greater Young's modulus than the main member of the quarter 13, and is therefore less stretchable and less bendable than the main member.

On the heel counter 4 of the present embodiment, the rear second portion B2 may not be provided on the rear center portion, and may be provided only on the medial side 11 of FIG. 12A. However, the rear second portion B2 is provided in the rear end portion 15, which is a 20% area of the medial side 11 extending from the rear end 1E.

Figure 13A:
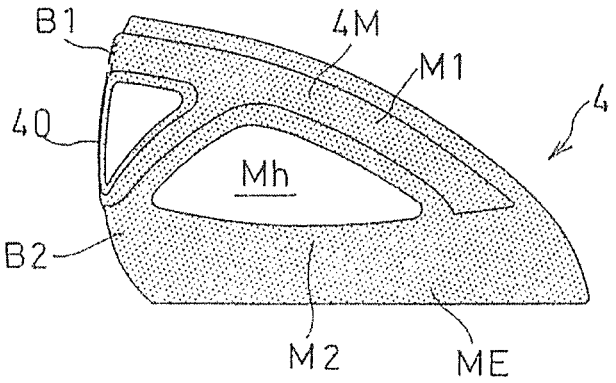
FIG. 13A and FIG. 13B are side views of the medial side and the lateral side, respectively, showing another example of a heel counter.
Figure 13B:
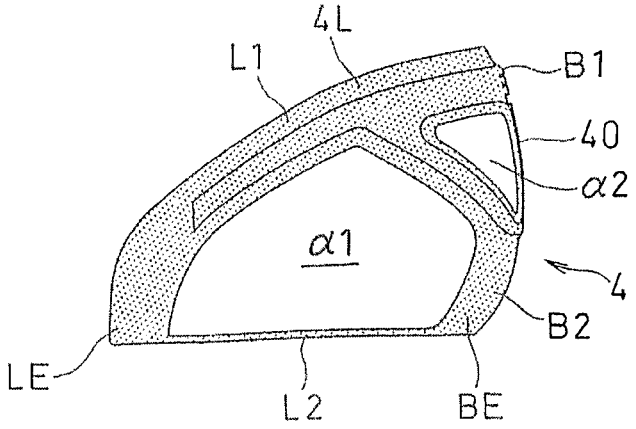

FIG. 13A and FIG. 13B show Embodiment 5.

This embodiment is provided with the lateral second portion L2 that connects together the tucked end portion LE of the lateral first portion L1 and the rear second portion B2 of the heel counter 4 of Embodiment 1. The lateral second portion L2 will slightly reinforce a part of the lateral side boundary portion 120 of FIG. 2, and slightly reinforce the midsole 2 directly under the lateral side boundary portion 120.

In this case, it is preferred that the lateral second portion L2 of the heel counter 4 of FIG. 13B is tucked between the upper 1 and the midsole 2 of FIG. 2 and not exposed to the outside.

A part or whole of the heel counter 4 may be exposed on the upper 1 or may be buried in the upper 1. Where a part or whole of the heel counter 4 is exposed on the upper 1, it is expected to further improve the stability property and the following property, and is expected to ensure the safety of the upper as a whole.

FIG. 17 to FIG. 21 show Embodiment 6.

Figure 17:
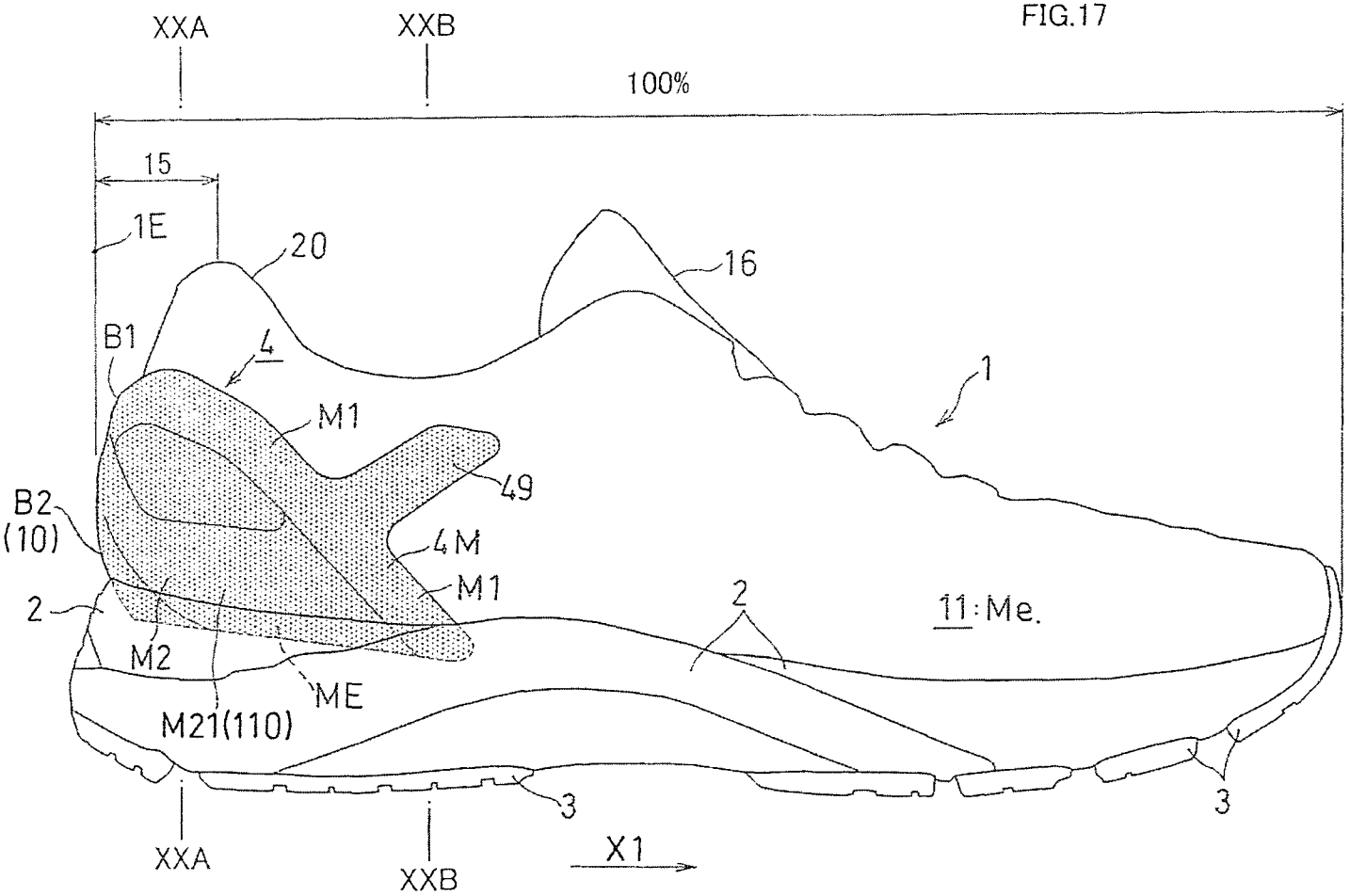
FIG. 17 is a schematic side view of the medial side showing an athletic shoe of Embodiment 6 of the present invention.

In FIG. 17, the shoe includes the upper 1, the midsole 2, the outsole 3 and the heel counter 4.

Figure 18:
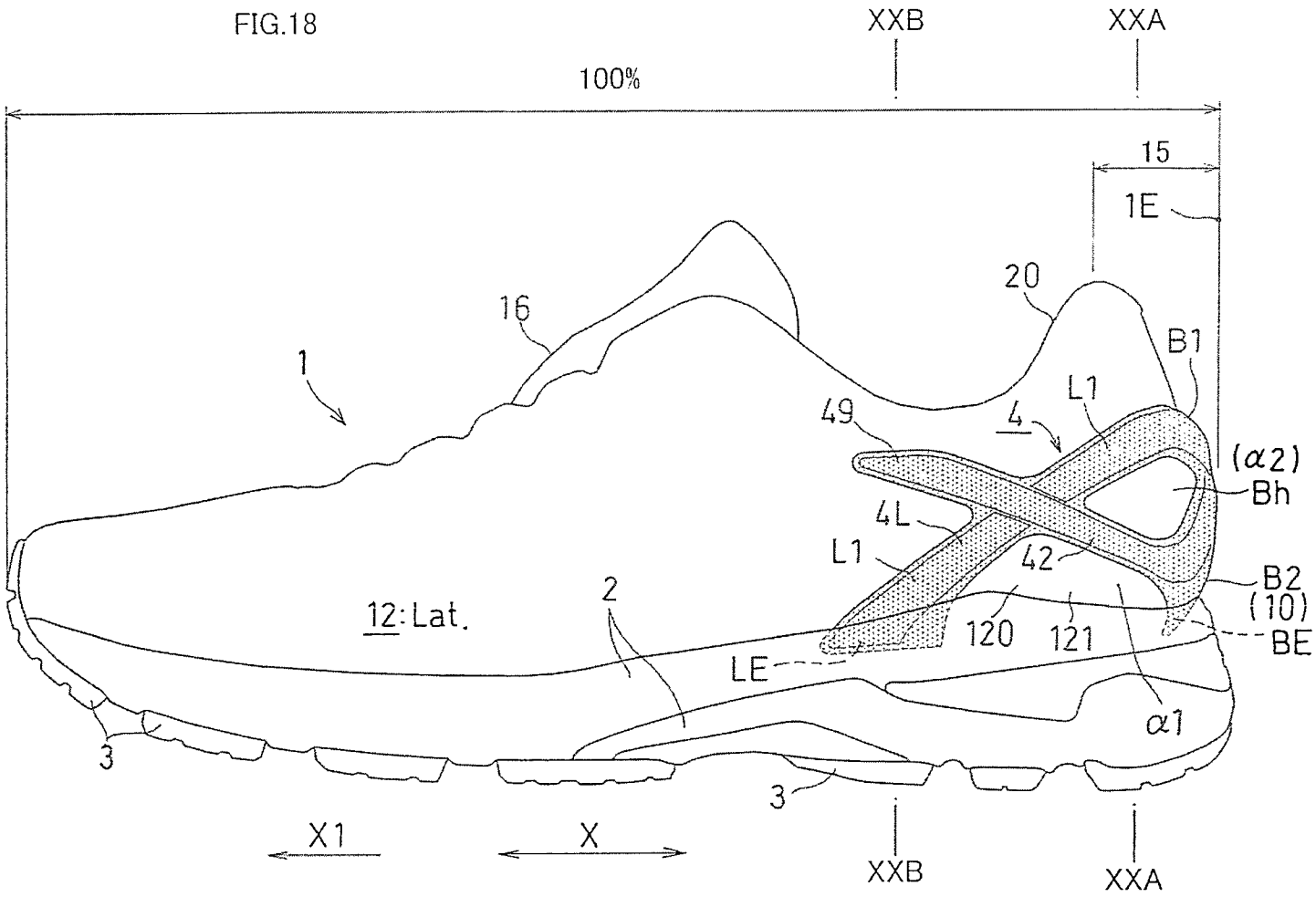
FIG. 18 is a schematic side view of the lateral side showing the athletic shoe of Embodiment 6.
Figure 19:
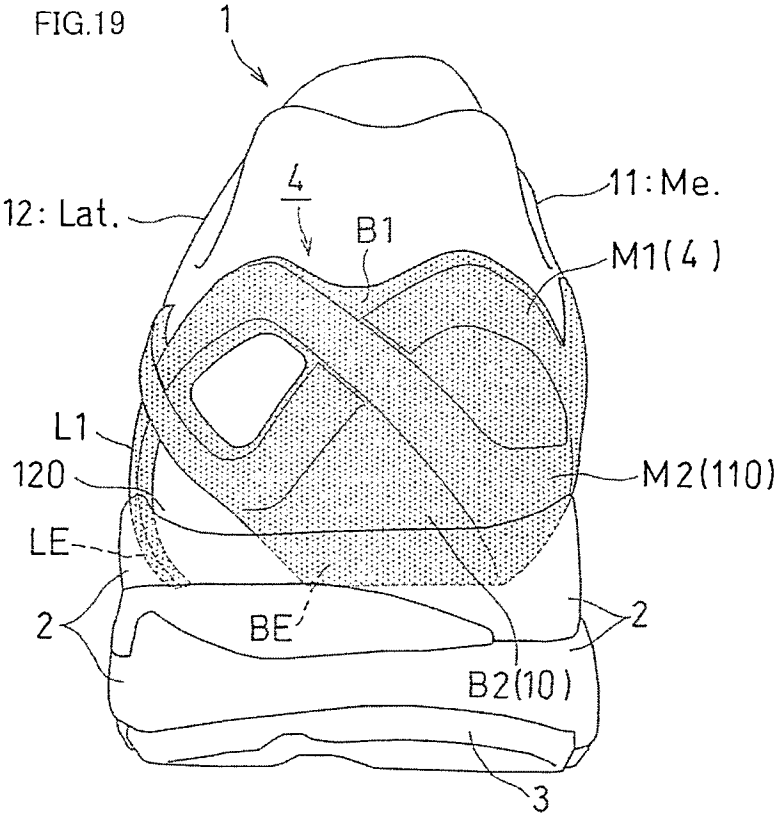
FIG. 19 is a back view showing the athletic shoe of Embodiment 6.

The upper 1 includes the lateral side boundary portion 120 between the upper 1 and the sole 2 on the lateral side 12 of the upper of FIG. 18, the medial side boundary portion 110 between the upper 1 and the sole 2 on the medial side 11 of the upper of FIG. 17, and the rear boundary portion 10 between the upper 1 and the sole 2 in the rear end portion 15 of the upper of FIG. 19. The medial side boundary portion 110 (FIG. 17) and the lateral side boundary portion 120 (FIG. 18) are continuous with each other with the rear boundary portion 10 interposed therebetween, as shown in FIG. 19.

Figure 20B:
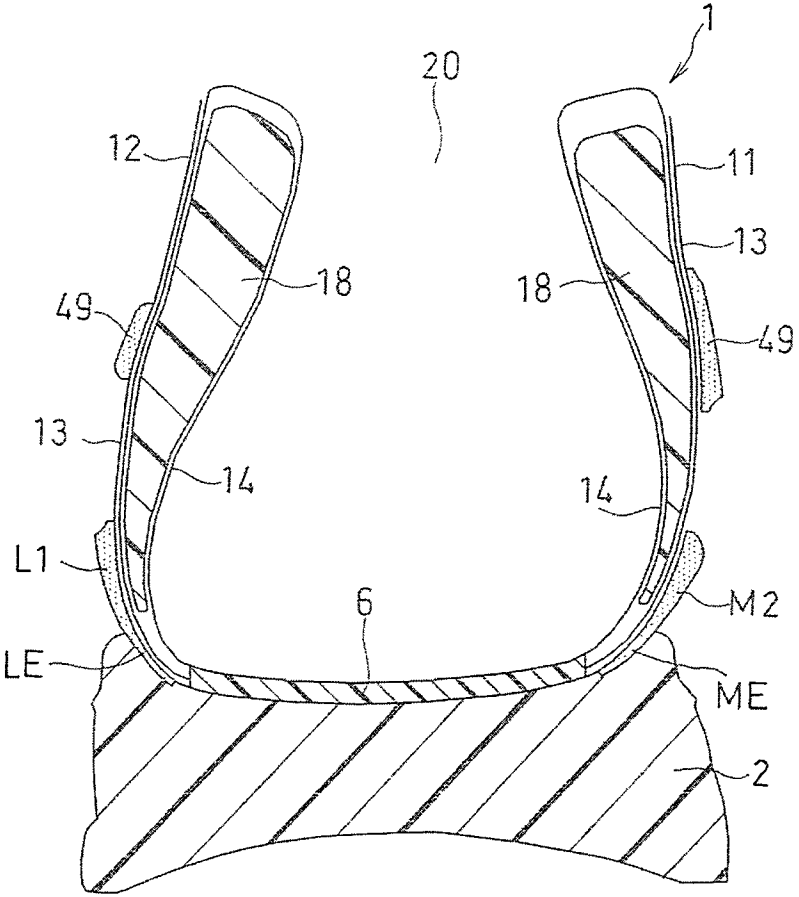
FIG. 20B is a XXB-XXB cross section of the upper according to Embodiment 6.
Figure 20A:
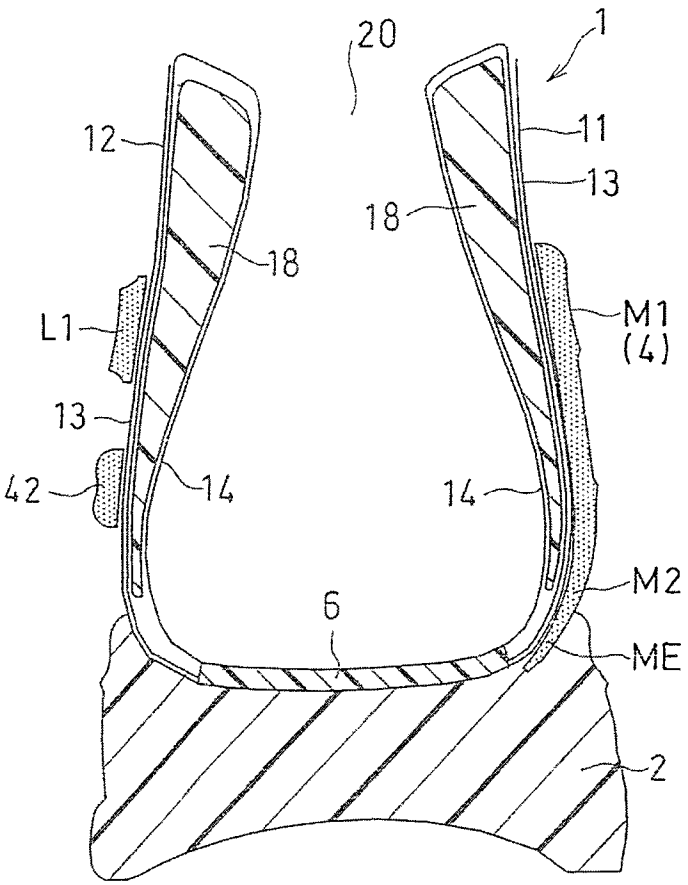
FIG. 20A is a XXA-XXA cross section of an upper according to Embodiment 6.
Figure 21:
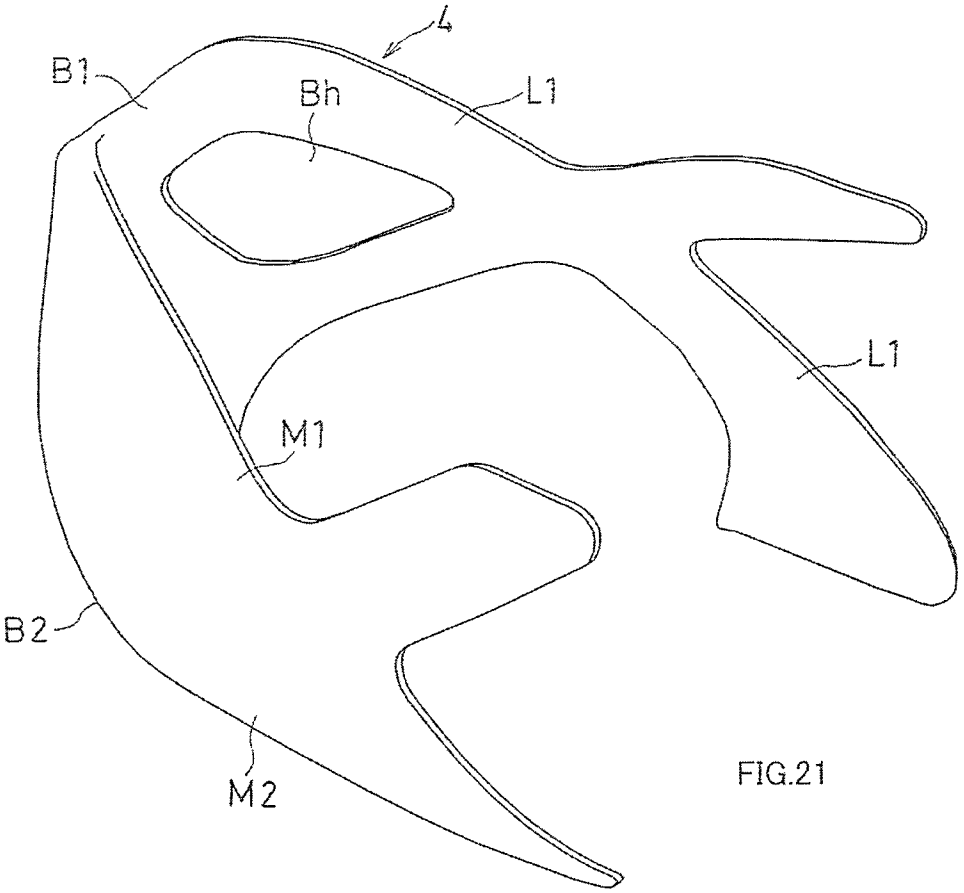
FIG. 21 is a perspective view of a heel counter according to Embodiment 6 as seen from the medial side.

The heel counter 4 made of a thermoplastic resin is attached to the outer surface of the upper 1, as shown in FIG. 20A and FIG. 20B. As shown in FIG. 21, the heel counter 4 includes the rear first portion B1, the rear second portion B2, the lateral first portion L1, the medial first portion M1 and the medial second portion M2, which are integrally and seamlessly continuous with each other.

The rear first portion B1 of FIG. 18 is placed between the sole 2 and the top line 20 of the upper 1, in the rear end portion 15 of the upper. The rear second portion B2 is placed in the rear boundary portion 10. As shown in FIG. 19, the rear first portion B1 and the rear second portion B2 of the present embodiment are vertically continuous with each other on the back surface of the upper.

In the example of FIG. 18, the lateral first portion L1 is continuous with the rear first portion B1, and is formed in a strip shape extending on the lateral side 12 of the upper toward the sole 2 and toward the diagonal anterior-downward direction.

The medial first portion M1 of FIG. 17 is continuous with the rear first portion B1, and extends toward the sole 2 on the medial side 11 of the upper. The medial second portion M2 is continuous with the rear second portion B2, and extends on the medial side 11 of the upper along the medial side boundary portion 110 from the rear second portion B2 toward the anterior direction X1. In the case of the present embodiment, the medial first portion M1, the medial second portion M2, the rear second portion B2 and the rear first portion B1 are continuous with each other, with no through holes or cutouts provided therebetween.

The lateral first portion L1 of FIG. 18 extends toward the sole 2 and toward the anterior direction X1 reaching the sole 2, and includes the lateral tucked end portion LE that is tucked between the sole 2 and the upper 1. The rear end of the lateral tucked end portion LE and the front end of the rear tucked end portion BE are unconnected and separated from each other in the anterior-posterior direction X. That is, in the case of the present embodiment, the lateral tucked end portion LE and the rear tucked end portion BE are continuous with each other by the strip-shaped lateral first portion L1 and the strip-shaped lateral bridge 42, but are not continuous with each other below these strip-shaped members.

The rear second portion B2 of FIG. 19 extends to the sole 2, and includes the rear tucked end portion BE that is tucked between the sole 2 and the upper 1. The medial second portion M2 of FIG. 17 includes the medial tucked end portion ME that is tucked between the sole 2 and the upper 1 and connects together the rear second portion B2 and the lower end portion of the medial first portion M1.

In FIG. 18, the heel counter 4 includes the lateral bridge 42 that extends toward the diagonal anterior-upward direction from the rear second portion B2 to the lateral first portion L1. Between the lateral bridge 42 and the lateral first portion L1 and the sole 2, the exposed portion 121 is provided where the lateral side boundary portion 120 of the upper 1 is exposed.

The lateral first portion L1, the lateral bridge 42, the rear second portion B2 and the sole 2 of FIG. 18 define the closed lower area α1. The lower area α1 is formed as a cutout of the heel counter 4. The exposed portion 121 is placed in the lower area α1. The lower area α1 and the exposed portion 121 are shaped so as to protrude upward.

With the structure where the lower area α1 and the exposed portion 121 are shaped so as to protrude upward, it is easy to lower the flexural rigidity gradually toward the lateral side boundary portion 120. Therefore, with such a structure, the amount of deformation of the lateral side boundary portion 120 upon heel contact is likely to increase, and it is easy to decrease the pronation.

Examples of the structure in which the flexural rigidity lowers gradually toward the lateral side boundary portion include, in addition to the upwardly-protruding exposed portion of the present embodiment, structures where the volume of a low-rigidity portion, such as an exposed portion or a thin portion having a small thickness, increases gradually downward.

In FIG. 18, the lateral first portion L1, the lateral bridge 42, the rear first portion B1 and the rear second portion B2 define the closed window area α2. In the window area α2, the heel counter 4 defines the rear through hole Bh running through the heel counter 4.

Note that in the case of the present embodiment, the areas α1 and α2, which are through holes, are not provided in the medial portion 4M of FIG. 17.

As in the present embodiment, the heel counter 4 may include a projecting portion 49 in the medial portion 4M of FIG. 17 and the lateral portion 4L of FIG. 18. The projecting portion 49 extends on the lateral portion 4L in the diagonal anterior-upward direction from the lateral bridge 42 toward the top line 20 to intersect with the lateral first portion L1.

The other structures of the present embodiment are similar to those of Embodiment 1 of FIG. 1 to FIG. 5 described above, and like members are denoted by like reference signs and will not be further described below.

FIG. 22 to FIG. 26 show Embodiment 7.

In the case of the present embodiment, the reinforcement device includes both a built-in heel counter 4 and an external heel counter 400.

The built-in heel counter 4 has a functional feature, and the external heel counter 400 has a design feature. The external heel counter 400 is attached to the outer surface of the rearfoot portion of the upper 1.

Figure 25A:
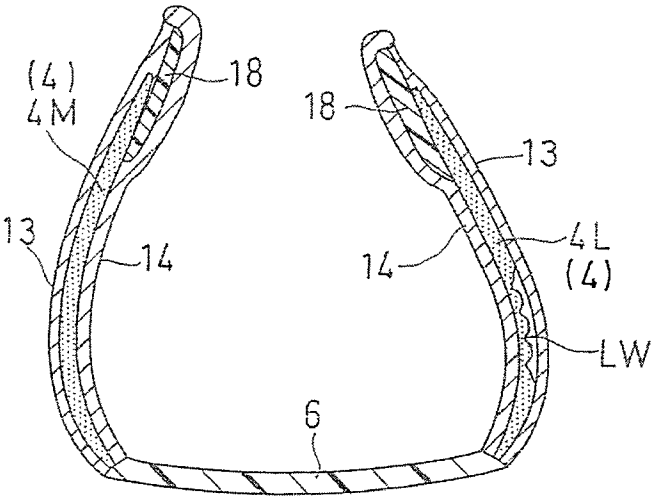
FIG. 25A is a XXVA-XXVA cross section of an upper according to Embodiment 7.
Figure 25B:
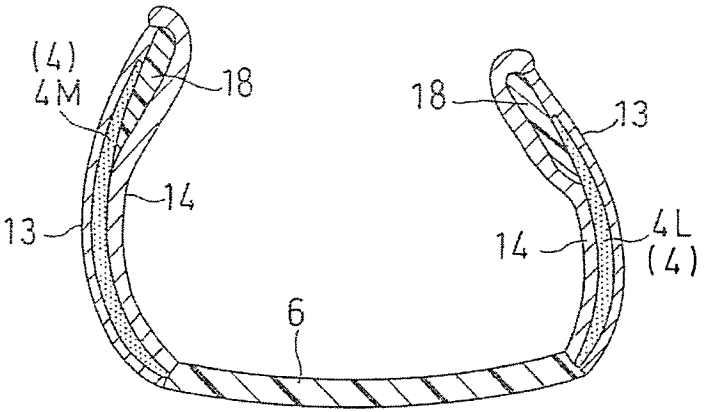
FIG. 25B is a XXVB-XXVB cross section of the upper according to Embodiment 7.

As shown in FIG. 25A and FIG. 25B, the upper 1 includes an inner skin 14 placed on the side that comes into contact with the foot, and an outer skin 13 on the opposite side. The built-in heel counter 4 is built in between the inner skin 14 and the outer skin 13.

Figure 22:
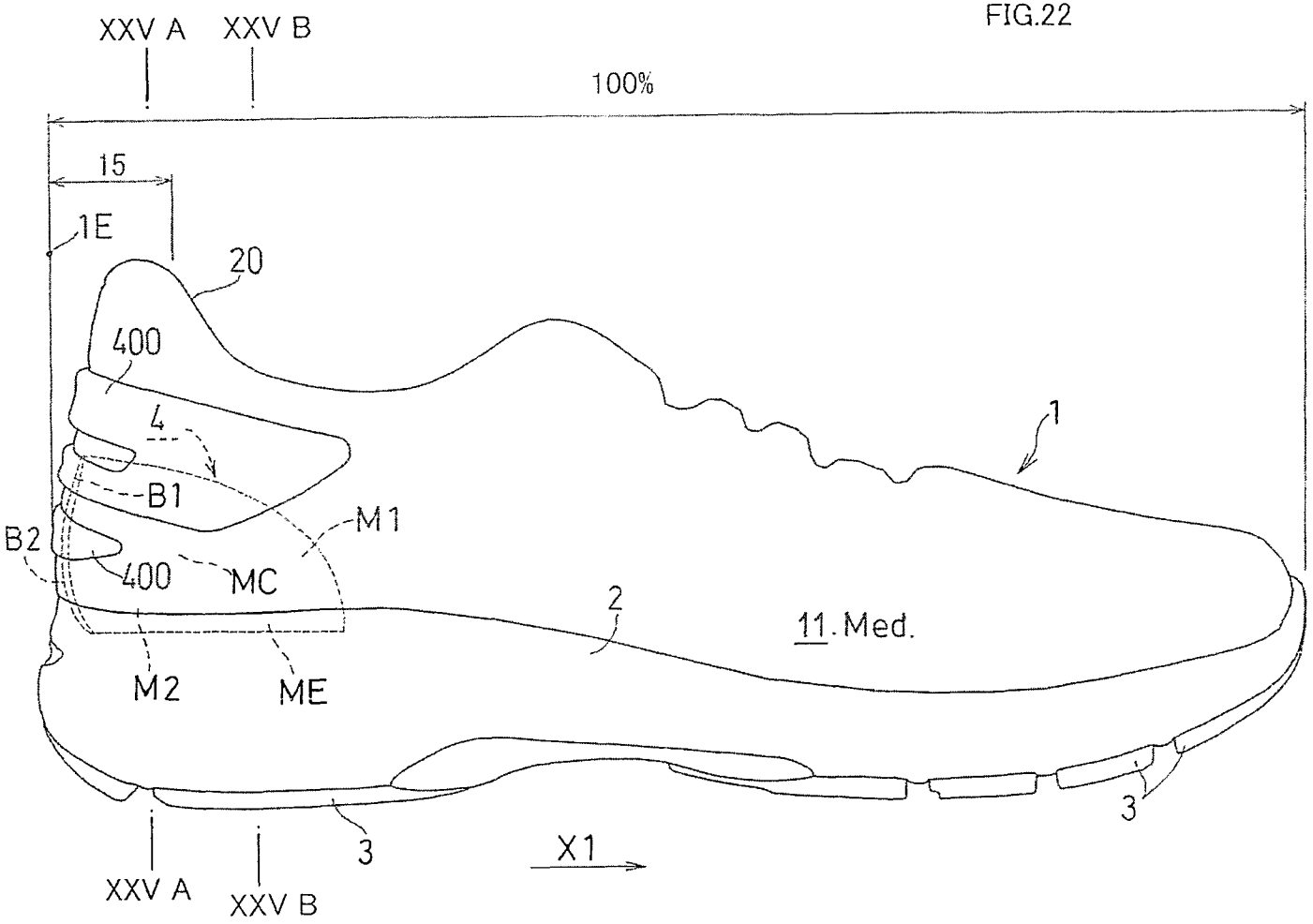
FIG. 22 is a schematic side view of the medial side showing an athletic shoe of Embodiment 7 of the present invention.
Figure 23:
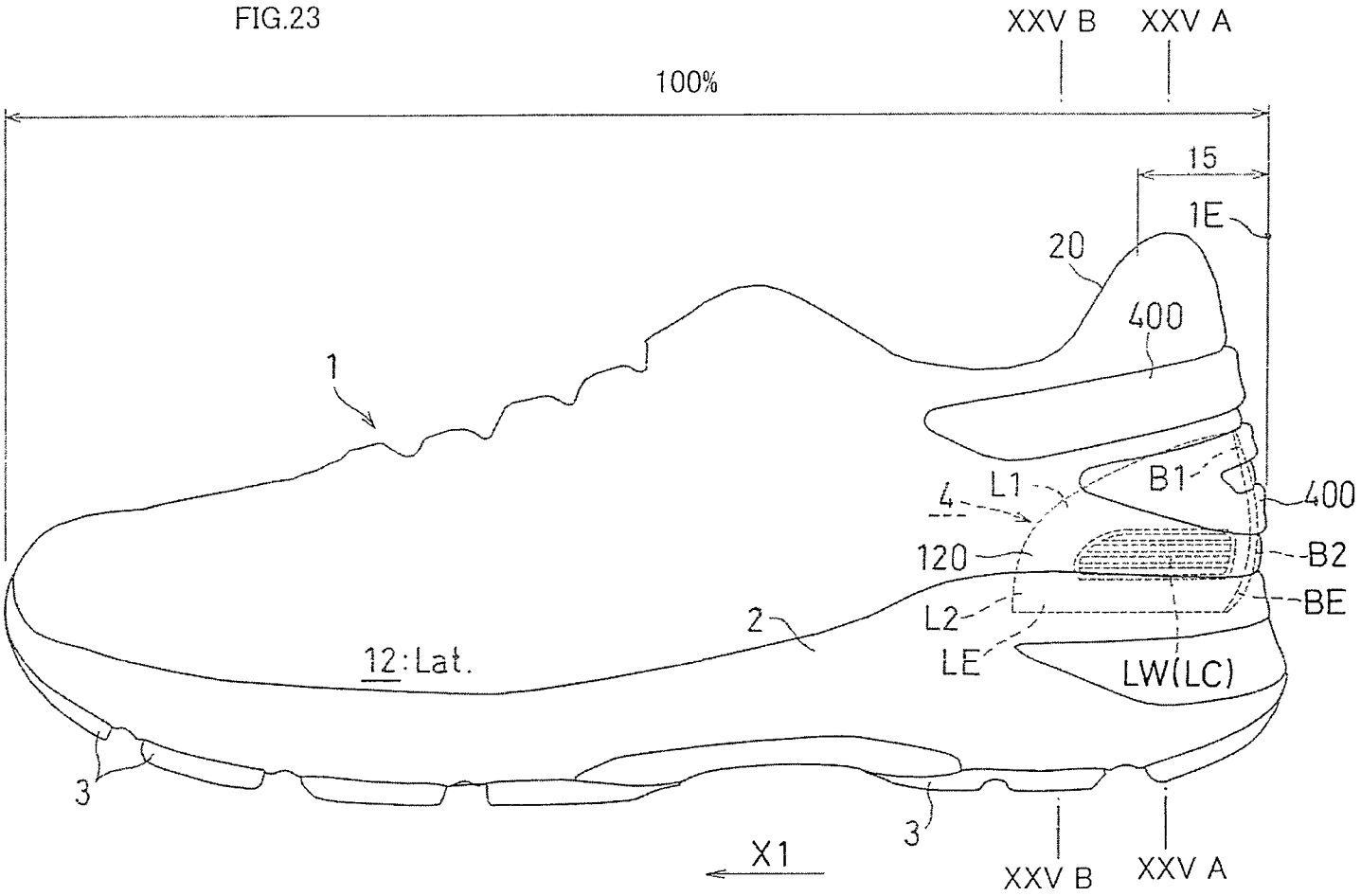
FIG. 23 is a schematic side view of the lateral side showing the athletic shoe of Embodiment 7.

Note that FIG. 25A and FIG. 25B are cross sections as seen from the front side of the shoe. In FIG. 25A and FIG. 25B, the midsole 2 of FIG. 22 and FIG. 23 is not shown. The built-in heel counter 4 is sandwiched between the upper 1 (the inner skin 14) and the midsole 2.

Figure 24:
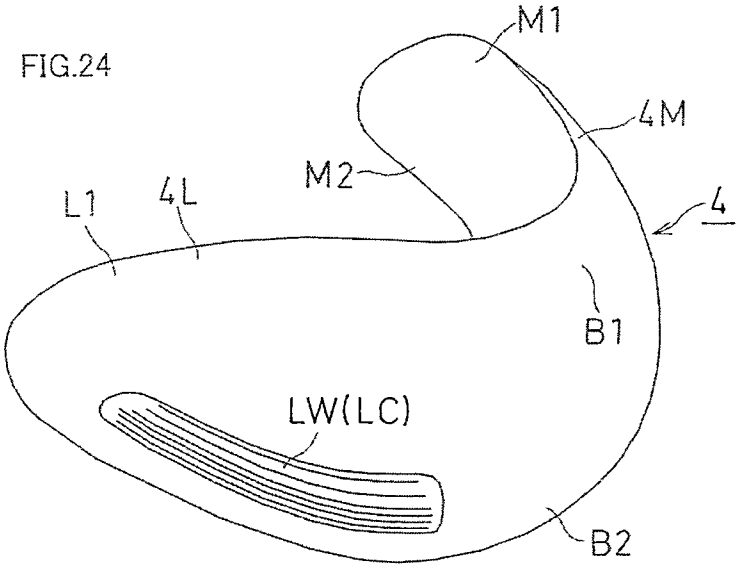
FIG. 24 is a perspective view showing a heel counter of Embodiment 7.

As shown in FIG. 24, the built-in counter 4 includes the rear first portion B1, the rear second portion B2, the lateral first portion L1, the medial first portion M1 and the medial second portion M2, which are integrally and seamlessly continuous with each other.

Figure 26:
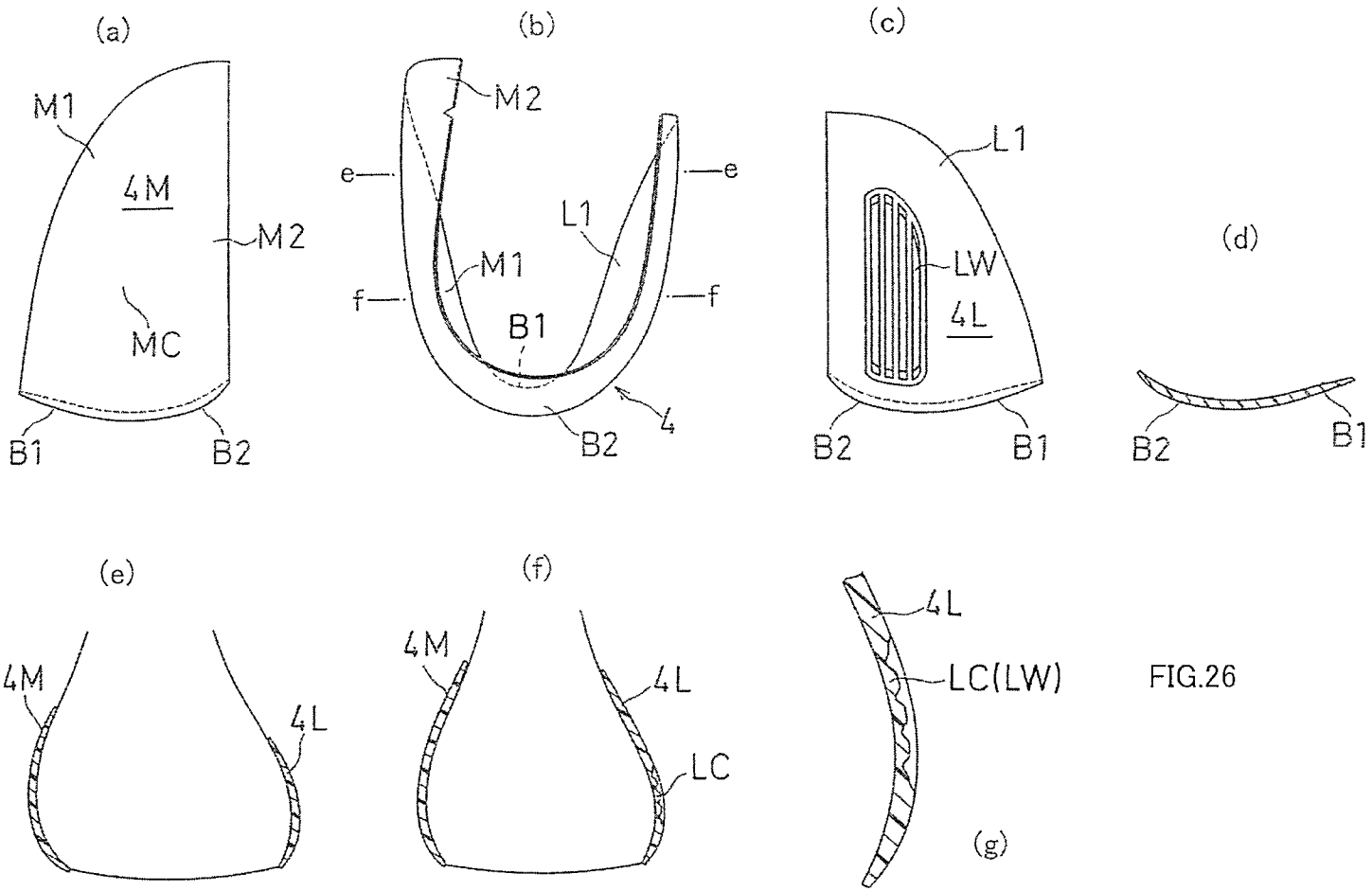
FIG. 26 shows a medial side view, a bottom view, a lateral side view, a vertical section, an e-e cross section, an f-f cross section and an enlarged cross section showing the heel counter of Embodiment 7.

As shown in FIG. 24 and FIG. 26, the built-in counter 4 is plate-shaped as a whole and further includes a low-rigidity portion LW whose rigidity is lower than that of the medial first portion M1 and the medial second portion M2, wherein the low-rigidity portion LW is surrounded by the rear first portion B1, the rear second portion B2 and the lateral first portion L1.

The built-in counter 4 of FIG. 23 is plate-shaped as a whole and includes the lateral second portion L2. The lateral second portion L2 is continuous with the rear second portion B2, and extends on the lateral side 12 of the upper along the lateral side boundary portion 120 from the rear second portion B2 toward the anterior direction X1.

The built-in counter 4 includes a lateral central portion LC surrounded by the rear first portion B1, the rear second portion B2, the lateral first portion L1 and the lateral second portion L2. The lateral central portion LC defines a thin portion having a smaller thickness than the surrounding portions, one or more slits, or one or more through holes.

As shown in FIG. 26(*g*), in the case of the present embodiment, the lateral central portion LC is shown to be a thin portion having a smaller thickness than the surrounding portions. Examples where the lateral central portion LC defines one or more slits or one or more through holes will be described later.

As shown in FIGS. 26(*a*) to 26(*g*), the built-in counter 4 includes a medial central portion MC surrounded by the rear first portion B1, the rear second portion B2, the medial first portion M1 and the medial second portion M2. The built-in counter 4 is plate-shaped as a whole and includes the medial portion 4M placed on the medial side and the lateral portion 4L placed on the lateral side, which are seamlessly continuous with each other.

The thickness of the lateral central portion LC is smaller than the thickness of the medial central portion MC. In the case of the present embodiment, the average thickness of the lateral portion 4L is smaller than the average thickness of the medial portion 4M. For example, the lateral central portion LC of the lateral portion 4L of FIGS. 26(*c*) and 26(*f*) is a thin portion as shown in FIG. 26(*g*), and the thin portion further includes a plurality of closed grooves extending in the anterior-posterior direction of the foot. Thus, the low-rigidity portion LW is formed.

Figure 27:
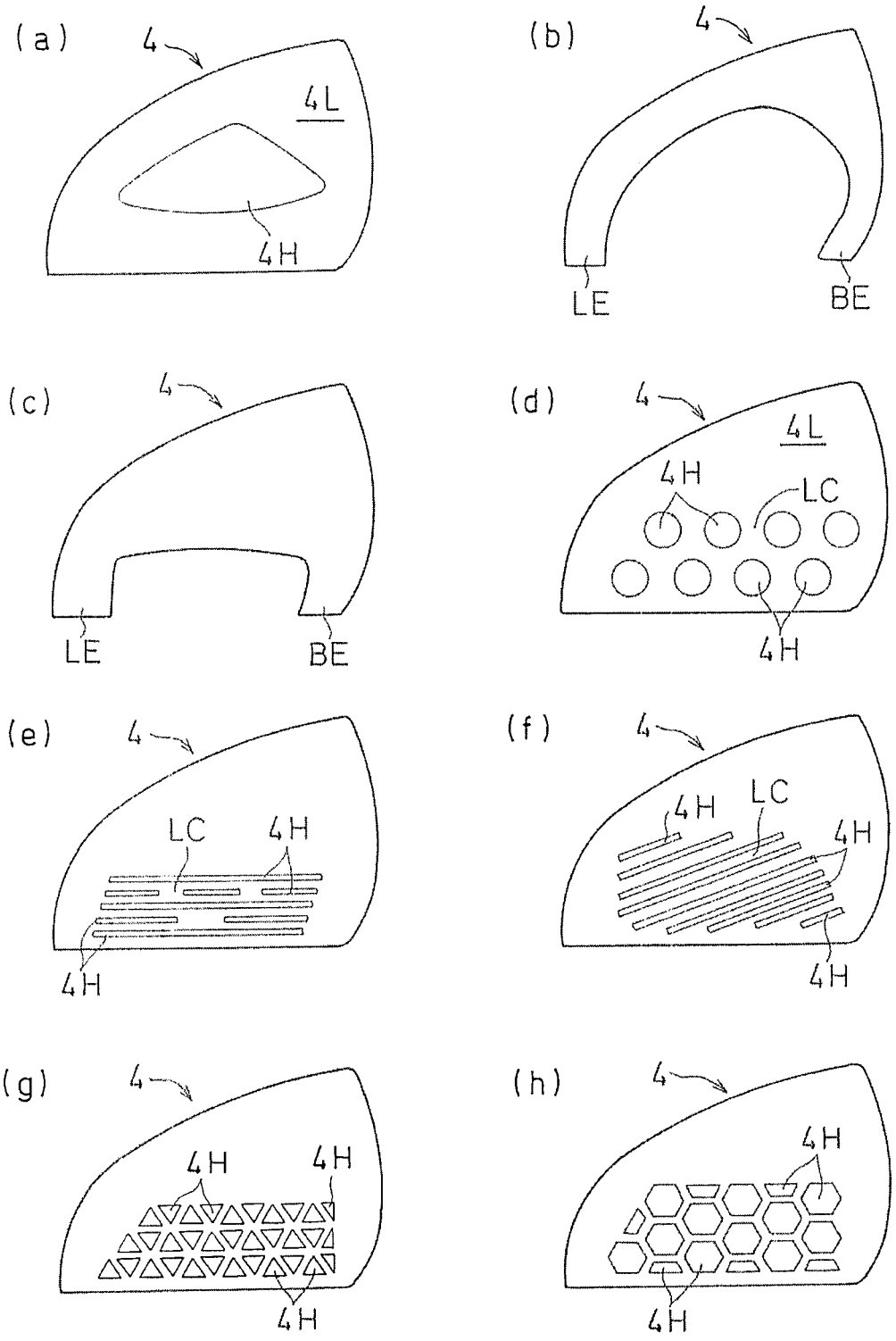
FIG. 27 relates to another example of a built-in heel counter, and is a lateral side view showing the structure of a low-rigidity portion of the lateral side.

FIG. 27 shows another example of the structure of the lateral portion 4L of the built-in heel counter 4 of FIG. 26(*c*).

As shown in FIGS. 27(*a*) and 27(*d*), the lateral portion 4L of the heel counter 4 may include one through hole 4H or a plurality of through holes 4H arranged in a scattered pattern provided in the lateral central portion LC.

As shown in FIGS. 27(*b*) and 27(*c*), the built-in counter 4 may be plate-shaped as a whole with a lower edge, and the lower edge may be formed in an upward arch shape between the lateral tucked end portion LE and the rear tucked end portion BE.

As shown in FIGS. 27(*e*) and 27(*f*), the through holes 4H may be groove-shaped extending in the anterior-posterior direction in the lateral central portion LC. The grooves may have the same length or different lengths. The direction in which the slits extend may be inclined, and there is no limitation on the direction of inclination.

Moreover, the number of groove-shaped through holes 4H may be one, though it is not shown in the figures.

As shown in FIGS. 27(*g*) and 27(*h*), the through holes 4H may be triangular or polygonal.

In the case of FIGS. 27(*a*) to 27(*h*), the through hole 4H may be a thin portion that is thin and recessed, thereby forming the low-rigidity portion LW.

Figure 28:
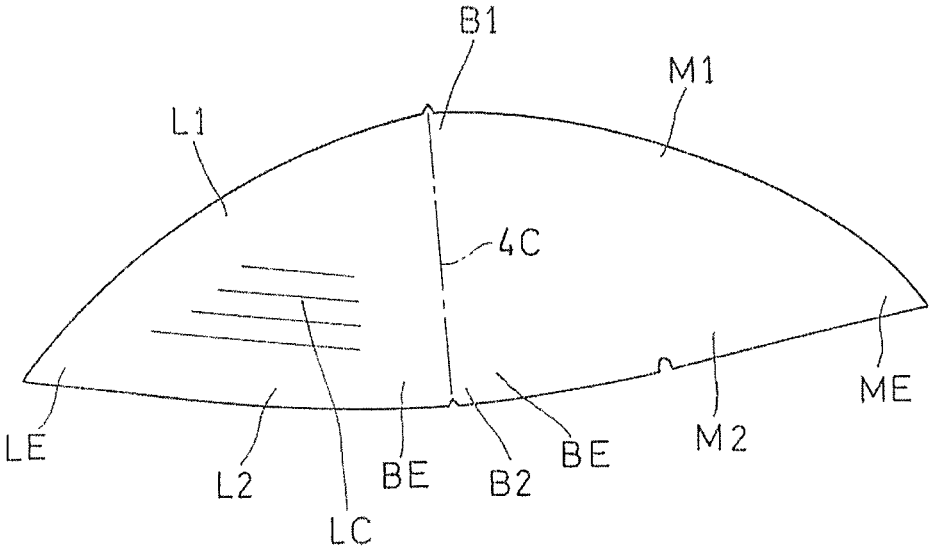
FIG. 28 relates to another example of a built-in heel counter, and is a plan view showing an unmolded state.

FIG. 28 shows another example of a built-in heel counter.

In this example, the heel counter 4 has a flat plate shape, and is built in the rearfoot portion of the upper while being bent along a center line 4C into a generally U-letter shape.

In FIG. 28, the counter 4 may include a low-rigidity portion LW formed in the lateral central portion LC by providing a plurality of slits in the lateral central portion LC. The slits may extend in the anterior-posterior direction in the lateral central portion LC. Also in this case, there may be one slit or a plurality of slits.

When the built-in heel counter is installed in the upper, no external heel counter may be provided.

Figure 29:
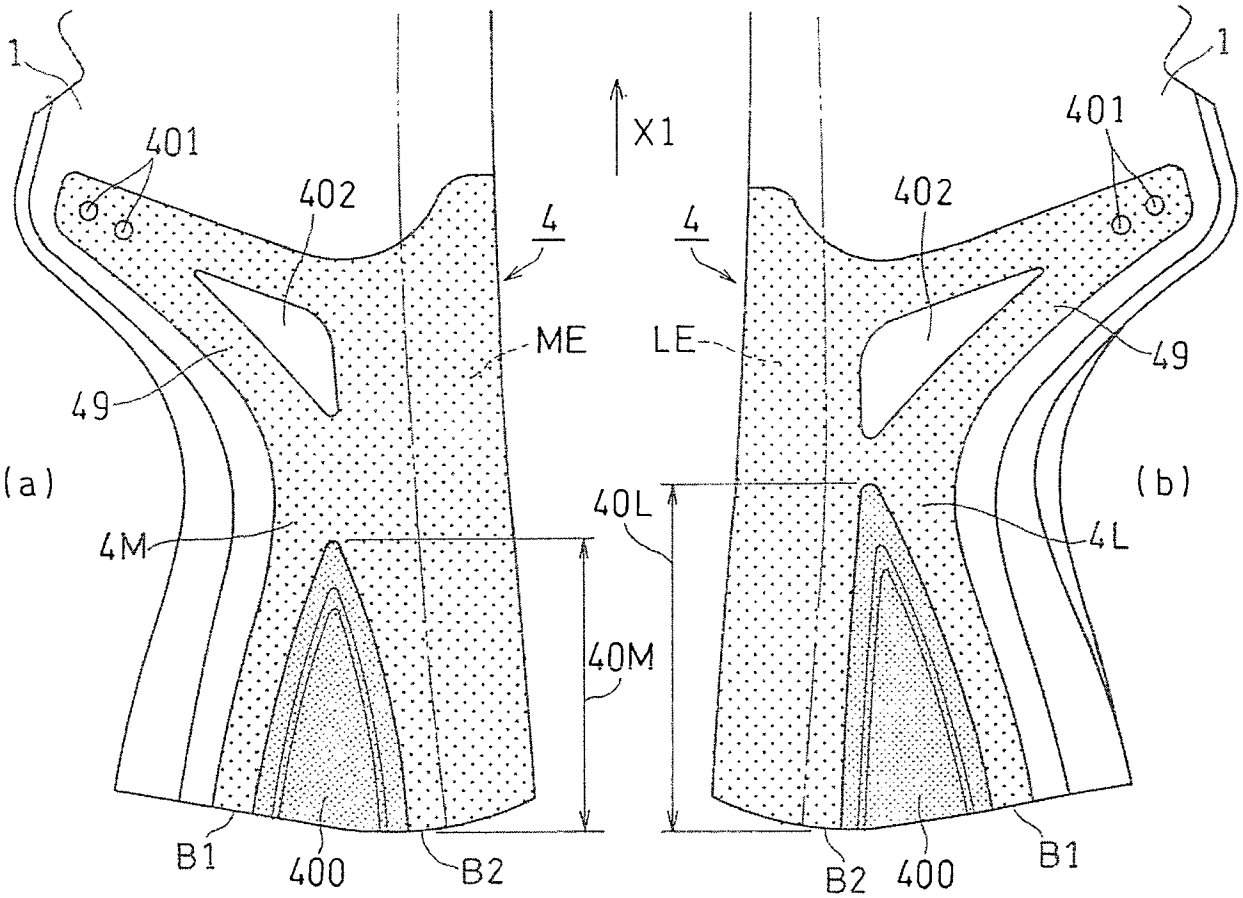
FIG. 29 is a medial side view and a lateral side view showing another example of an external heel counter.

FIG. 29 shows, together with a part of the upper 1, another example of an external heel counter 4.

In FIG. 29, a thin portion 400 is provided to extend from the rear end of the external heel counter 4 toward the medial side and the lateral side. The distance 40M from the rear end to the front end of the thin portion 400 in the medial portion 4M of FIG. 29(*a*) is shorter than the distance 40L in the lateral portion 4L of FIG. 29(*b*). The external heel counter 4 is dotted, and the thin portion 400 are densely dotted.

Note that the two-dot-chain line denotes the upper edge line of the midsole.

A pattern of small protrusions/depressions may be provided in a portion of the external heel counter 4.

In the present embodiment, the external heel counter 4 is provided with eyelets 401 through which shoelaces are passed. A through hole 402 may be provided in the vicinity of the eyelets 401.

Note that the external heel counter 4 of the present embodiment will allow the upper to be in close contact with the heel.

FIG. 30 shows still another example of the external heel counter 4.

In the present embodiment, a bridge 404 forming a through hole 403 is provided to extend from the rear end of the external heel counter 4 to the lateral side and the medial side. In the case of the present embodiment, because of the bridge of the rear end portion, the lateral portion 4L of FIG. 30(*a*) has a lower rigidity than the medial portion 4M of FIG. 30(*b*).

While preferred embodiments have been described above with reference to the drawings, various obvious changes and modifications will readily occur to those skilled in the art upon reading the present specification.

The sole placed under the upper may include only a so-called "outsole".

When the heel counter is a built-in heel counter, the heel counter may be a thick cardboard or a cardboard impregnated with a resin, as well as a thermoplastic resin.

Thus, such changes and modifications are deemed to fall within the scope of the present invention, which is defined by the appended claims.

INDUSTRIAL APPLICABILITY

The present invention is applicable to athletic shoes such as running shoes and also to various other types of shoes such as walking shoes.

REFERENCE SIGNS LIST

1: Upper, 1E: Rear end, 10: Boundary portion, 11: Medial side of upper, 110: Medial side boundary portion, 12: Lateral side of upper, 120: Lateral side boundary portion, 121: Exposed portion, 13: Quarter, 14: Quarter lining, 15: Rear end portion, 16: Tongue, 17: Heel portion, 18: Cushioning material

2: Midsole, 20: Top line, 3: Outsole, 6: Insole

4: Heel counter (reinforcement device), 40 to 42: Bridges, 49: Projecting portion, 4C: Center line, 4H: Through hole, 4L: Lateral portion, 4M: Medial portion, 400: External heel counter B1: Rear first portion, B2: Rear second portion, Bh: Rear through hole, BE: Rear tucked end portion L1: Lateral first portion, L2: Lateral second portion, LE: Lateral tucked end portion, LC: Lateral central portion LW: Low-rigidity portion M1: Medial first portion, M2: Medial second portion, M21: Exposed portion, MC: Medial central portion, ME: Medial tucked end portion Mh: Medial through hole B8: Talus bone, B9: Calcaneal bone, J8: Subtalar joint Ml: Lateral malleolus, Mm: Medial malleolus α1: Lower area, α2: Window area, X: Anterior-posterior direction, X1: Anterior $W_L$, $W_M$: Width

The invention claimed is:

1. A shoe comprising:

an upper, a reinforcement device reinforcing the upper, and a sole attached to the upper, wherein:

the upper includes a lateral side boundary portion positioned on a lateral side of the upper and adjacent to the sole, a medial side boundary portion positioned on a medial side of the upper and adjacent to the sole, and a rear boundary portion positioned on a rear side of the upper and adjacent to the sole;

the medial side boundary portion, the rear boundary portion, and the lateral side boundary portion are continuous with each other, and the rear boundary portion extends between the medial side boundary portion and the lateral side boundary portion; and the reinforcement device comprises:

a rear first portion placed between the sole and a top line of the upper in a rear end portion of the upper;

a rear second portion placed in the rear boundary portion;

a lateral first portion being continuous with the rear first portion and extending toward the sole on the lateral side of the upper;

a medial first portion being continuous with the rear first portion and extending toward the sole on the medial side of the upper; and a medial second portion being continuous with the rear second portion and extending toward an anterior direction from the rear second portion along the medial side boundary portion on the medial side of the upper, wherein:

the lateral first portion extends toward the sole and toward the anterior direction reaching the sole, the lateral first portion including a lateral tucked end portion tucked between the sole and the upper;

the rear second portion extends to the sole, the rear second portion including a rear tucked end portion tucked between the sole and the upper; and the medial second portion includes a medial tucked end portion that is tucked between the sole and the upper and connects together the rear second portion and a lower end portion of the medial first portion, and wherein the reinforcement device includes a low-rigidity portion having a rigidity that is lower than a rigidity of the medial first portion and lower than a rigidity of the medial second portion;

the reinforcement device is a heel counter made of a thermoplastic resin;

the upper includes an inner skin placed on a side configured to come into contact with a foot, and an outer skin on an opposite side;

the heel counter is a built-in counter that is built in between the inner skin and the outer skin; and the built-in counter includes the rear first portion, the rear second portion, the lateral first portion, the medial first portion and the medial second portion, which are integrally and seamlessly continuous with each other;

the built-in counter further includes a lateral second portion, the lateral second portion being continuous with the rear second portion, and extending on the lateral side of the upper along the lateral side boundary portion from the rear second portion toward the anterior direction;

the built-in counter includes a lateral central portion surrounded by the rear first portion, the rear second portion, the lateral first portion and the lateral second portion; and (i) the lateral central portion defines a plurality of through holes arranged in a scattered pattern, or (ii) the lateral central portion defines a plurality of slits extending in an anterior-posterior direction.

2. A shoe comprising:

an upper, a reinforcement device reinforcing the upper, and a sole attached to the upper, wherein:

the upper includes a lateral side boundary portion positioned on a lateral side of the upper and adjacent to the sole, a medial side boundary portion positioned on a medial side of the upper and adjacent to the sole, and a rear boundary portion positioned on a rear side of the upper and adjacent to the sole;

the medial side boundary portion, the rear boundary portion, and the lateral side boundary portion are continuous with each other, and the rear boundary portion extends between the medial side boundary portion and the lateral side boundary portion; and the reinforcement device comprises:

a rear first portion placed between the sole and a top line of the upper in a rear end portion of the upper;

a rear second portion placed in the rear boundary portion;

a lateral first portion being continuous with the rear first portion and extending toward the sole on the lateral side of the upper;

a medial first portion being continuous with the rear first portion and extending toward the sole on the medial side of the upper; and a medial second portion being continuous with the rear second portion and extending toward an anterior direction from the rear second portion along the medial side boundary portion on the medial side of the upper, wherein:

the lateral first portion extends toward the sole and toward the anterior direction reaching the sole, the lateral first portion including a lateral tucked end portion tucked between the sole and the upper;

the rear second portion extends to the sole, the rear second portion including a rear tucked end portion tucked between the sole and the upper; and the medial second portion includes a medial tucked end portion that is tucked between the sole and the upper and connects together the rear second portion and a lower end portion of the medial first portion, and wherein the reinforcement device includes a low-rigidity portion having a rigidity that is lower than a rigidity of the medial first portion and lower than a rigidity of the medial second portion;

the reinforcement device is a heel counter made of a thermoplastic resin;

the upper includes an inner skin placed on a side configured to come into contact with a foot, and an outer skin on an opposite side;

the heel counter is a built-in counter that is built in between the inner skin and the outer skin;

the built-in counter includes the rear first portion, the rear second portion, the lateral first portion, the medial first portion and the medial second portion, which are integrally and seamlessly continuous with each other;

the built-in counter is formed with a lower edge; and the lower edge is formed in an upward arch shape between the lateral tucked end portion and the rear tucked end portion.

* * * * *